US011045001B2

(12) United States Patent
Kumazawa

(10) Patent No.: US 11,045,001 B2
(45) Date of Patent: Jun. 29, 2021

(54) CHAIR AND STRUCTURE BODY THEREOF

(71) Applicant: Aichi Co., Ltd., Nagoya (JP)

(72) Inventor: Taku Kumazawa, Ichinomiya (JP)

(73) Assignee: AICHI CO., LTD., Nagoya (JP)

( * ) Notice: Subject to any disclaimer, the term of this patent is extended or adjusted under 35 U.S.C. 154(b) by 0 days.

(21) Appl. No.: 16/334,208

(22) PCT Filed: Jan. 20, 2017

(86) PCT No.: PCT/JP2017/002030
§ 371 (c)(1),
(2) Date: Mar. 18, 2019

(87) PCT Pub. No.: WO2018/055781
PCT Pub. Date: Mar. 29, 2018

(65) Prior Publication Data

US 2019/0274431 A1 Sep. 12, 2019

(30) Foreign Application Priority Data

Sep. 23, 2016 (JP) ..... JP2016-185900
Sep. 23, 2016 (JP) ..... JP2016-185901
(Continued)

(51) Int. Cl.
*A47C 5/04* (2006.01)
*A47C 7/44* (2006.01)
(Continued)

(52) U.S. Cl.
CPC ..... *A47C 7/002* (2013.01); *A47C 5/08* (2013.01); *A47C 5/12* (2013.01); *A47C 7/16* (2013.01); *A47C 7/40* (2013.01)

(58) Field of Classification Search
CPC .... A47C 5/06; A47C 7/40; A47C 3/04; A47C 4/24; A47C 5/12; A47C 31/02;
(Continued)

(56) References Cited

U.S. PATENT DOCUMENTS 2,719,579 A * 10/1955 Schaffer ..... A47C 5/046 297/440.15
3,724,897 A * 4/1973 Faiks ..... A47C 1/124 297/447.3
(Continued)

FOREIGN PATENT DOCUMENTS

JP S47037006 U 12/1972
JP S58133635 U 9/1983
(Continued)

OTHER PUBLICATIONS

International Preliminary Report on Patentability for International Patent Application No. PCT/JP2017/002030, dated Apr. 4, 2019, 12 pages.
(Continued)

*Primary Examiner* — Shin H Kim
(74) *Attorney, Agent, or Firm* — Withrow & Terranova, P.L.L.C.; Vincent K. Gustafson

(57) ABSTRACT

Provided is a chair including a support member that is at least a seat body and a backrest to support an occupant. The support member includes a composite portion at least a part of an outer periphery of the support member. The composite portion includes a first outer periphery that is a part of the first member and a second outer periphery that is a part of the second member. The first outer periphery and the second outer periphery are arranged to overlap each other in a thickness direction of the support member. In the composite portion, at least a part of the first outer periphery is formed into a thin portion thinner in the thickness direction than a part located on an outside of at least the part of the first outer periphery in the first member.

9 Claims, 18 Drawing Sheets

(30) Foreign Application Priority Data

Nov. 16, 2016 (JP) ..... JP2016-223485
Nov. 16, 2016 (JP) ..... JP2016-223486

(51) Int. Cl.

| | |
|---|---|
| ***A47C 7/00*** | (2006.01) |
| ***A47C 7/40*** | (2006.01) |
| ***A47C 5/12*** | (2006.01) |
| ***A47C 5/08*** | (2006.01) |
| ***A47C 7/16*** | (2006.01) |

(58) Field of Classification Search

CPC .. A47C 3/12; A47C 5/04; A47C 7/002; A47C 7/02; A47C 7/16; A47C 7/828; A47C 7/405; A47C 11/005; A47C 1/124

USPC ..... 297/170, 171, 172, 451.1, 446, 452.18

See application file for complete search history.

(56) References Cited

U.S. PATENT DOCUMENTS

| | | | | | |
|---|---|---|---|---|---|
| 4,046,422 | A * | 9/1977 | Ambasz | A47C 3/025 | 297/248 |
| 4,305,617 | A * | 12/1981 | Benoit | A47C 7/40 | 297/448.2 |
| 5,076,646 | A * | 12/1991 | Matte | A47C 3/12 | 297/353 |
| 5,338,091 | A * | 8/1994 | Miller | A47C 5/06 | 297/218.4 |
| 5,393,126 | A * | 2/1995 | Boulva | A47C 5/06 | 297/440.11 |
| 5,961,184 | A * | 10/1999 | Balderi | A47C 5/04 | 297/440.15 |
| 5,997,094 | A * | 12/1999 | Cvek | A47C 3/04 | 297/239 |
| 6,234,571 | B1 * | 5/2001 | Atkins | A47C 3/04 | 297/16.1 |
| 6,279,991 | B1 * | 8/2001 | Atkins | A47C 4/24 | 297/16.1 |
| 6,422,645 | B1 * | 7/2002 | Smith | A47C 3/04 | 297/239 |
| 6,439,665 | B1 * | 8/2002 | Cvek | A47C 7/16 | 297/440.11 |
| 6,625,830 | B2 * | 9/2003 | Lampel | A47C 27/146 | 297/452.26 |
| 6,886,890 | B2 * | 5/2005 | Rowland | A47C 7/02 | 297/228.1 |
| 6,899,398 | B2 * | 5/2005 | Coffield | A47C 7/282 | 297/452.56 |
| 6,957,860 | B1 * | 10/2005 | Leist | A47C 3/04 | 297/239 |
| 7,108,330 | B2 * | 9/2006 | Mizelle | A47C 4/06 | 297/218.1 |
| 7,111,906 | B2 * | 9/2006 | Heisey | A47C 7/22 | 297/440.2 |
| 7,871,131 | B2 * | 1/2011 | Rowland | A47C 5/06 | 297/230.11 |
| 8,317,269 | B2 * | 11/2012 | Smith | A47C 1/124 | 297/239 |
| 8,322,787 | B2 * | 12/2012 | Smith | A47C 1/124 | 248/230.5 |
| 8,454,093 | B2 * | 6/2013 | Smith | A47C 3/04 | 297/239 |
| D694,034 | S * | 11/2013 | Tanaka | D6/373 | |
| 8,777,321 | B2 * | 7/2014 | Masunaga | A47C 3/023 | 297/440.15 |
| 9,504,326 | B1 * | 11/2016 | Cartis | A47C 1/032 | |
| 9,826,838 | B2 * | 11/2017 | Piretti | A47C 5/06 | |
| 10,448,744 | B2 * | 10/2019 | Phillips | A47C 7/14 | |
| 2003/0071509 | A1 * | 4/2003 | Neil | A47C 21/022 | 297/440.11 |
| 2003/0127887 | A1 * | 7/2003 | Laws | A47C 31/02 | 297/55 |
| 2007/0132302 | A1 * | 6/2007 | Smith | A47C 31/023 | 297/445.1 |
| 2008/0106136 | A1 * | 5/2008 | Heidmann | A47C 7/28 | 297/452.56 |
| 2010/0176646 | A1 * | 7/2010 | Rowland | A47C 5/06 | 297/452.56 |
| 2010/0244515 | A1 * | 9/2010 | Ivicevic | A47C 1/03272 | 297/239 |
| 2011/0025104 | A1 * | 2/2011 | Fusao | A47C 4/02 | 297/55 |
| 2011/0084537 | A1 * | 4/2011 | Lin | A47C 4/24 | 297/452.18 |
| 2011/0084538 | A1 * | 4/2011 | Lin | A47C 7/185 | 297/452.18 |
| 2012/0187741 | A1 | 7/2012 | Kumazawa | | |
| 2012/0299348 | A1 * | 11/2012 | Kusch | A47C 11/005 | 297/232 |
| 2012/0313419 | A1 * | 12/2012 | Masunaga | A47C 7/40 | 297/452.18 |
| 2013/0175844 | A1 * | 7/2013 | Noe | A47C 5/14 | 297/445.1 |
| 2013/0313883 | A1 * | 11/2013 | Machael | A47C 7/02 | 297/452.18 |
| 2014/0145480 | A1 * | 5/2014 | Johnson | A47C 5/04 | 297/239 |
| 2014/0183914 | A1 | 7/2014 | Cvek | | |
| 2016/0242547 | A1 * | 8/2016 | Isquith | F41H 5/0485 | |
| 2019/0274431 | A1 * | 9/2019 | Kumazawa | A47C 5/08 | |
| 2020/0046122 | A1 * | 2/2020 | Ogg | A47C 4/14 | |

FOREIGN PATENT DOCUMENTS

| | | | |
|---|---|---|---|
| JP | 3064780 | U | 1/2000 |
| JP | 2001224461 | A | 8/2001 |
| JP | 2001327360 | A | 11/2001 |
| JP | 2003111637 | A | 4/2003 |
| JP | 2003284625 | A | 10/2003 |
| JP | 200534297 | A | 2/2005 |
| JP | 2010005285 | A | 1/2010 |
| JP | 2010094192 | A | 4/2010 |
| JP | 2010104815 | A | 5/2010 |
| JP | 2012090685 | A | 5/2012 |
| JP | 2012090788 | A | 5/2012 |
| JP | 2014046128 | A | 3/2014 |
| JP | 2016131714 | A | 7/2016 |
| WO | 2005025379 | A1 | 3/2005 |

OTHER PUBLICATIONS

International Search Report (Form PCT/ISA/210) for International Application No. PCT/JP2017/002030, dated Feb. 28, 2017 (English translation), 2 pages.

Written Opinion (Form PCT/ISA/237) for International Application No. PCT/JP2017/002030, dated Feb. 28, 2017 9 pages (including partial English translation encompassing Section V only).

Notice of Reasons for Rejection for Japanese Patent Application No. 2016-185900, dated Sep. 29, 2020, 10 pages including English translation.

Notice of Reasons for Refusal for Japanese Patent Application No. 2016-185900, dated Apr. 21, 2020, 7 pages including English translation.

Notice of Reasons for Refusal for Japanese Patent Application No. 2016-185901, dated Apr. 21, 2020, 6 pages including English translation.

Notice of Reasons for Refusal for Japanese Patent Application No. 2016-223485, dated May 19, 2020, 6 pages including English translation.

Notice of Reasons for Refusal for Japanese Patent Application No. 2016-223486, dated May 19, 2020, 6 pages including English translation.

Extended European Search Report for European Patent Application No. 17852562.2 dated Apr. 17, 2020, 10 pages.

Notice of Reasons for Refusal for Japanese Patent Application No. 2016-223485, dated Feb. 2, 2021, 14 pages.

(56) References Cited

OTHER PUBLICATIONS

Notice of Reasons for Refusal for Japanese Patent Application No. 2016-185900, dated Apr. 13, 2021 (15 pages including English translation).

* cited by examiner

CHAIR AND STRUCTURE BODY THEREOF

CROSS-REFERENCE TO RELATED APPLICATION

This application is a 35 U.S.C. § 371 national phase filing of International Application No. PCT/JP2017/002030 filed on Jan. 20, 2017, and claims the benefit of Japanese Patent Application No. 2016-185900 and Japanese Patent Application No. 2016-185901 filed Sep. 23, 2016 in the Japan Patent Office, and Japanese Patent Application No. 2016-223485 and Japanese Patent Application No. 2016-223486 filed Nov. 16, 2016 in the Japan Patent Office, wherein the entire disclosures of Japanese Patent Application No. 2016-185900, Japanese Patent Application No. 2016-185901, Japanese Patent Application No. 2016-223485, Japanese Patent Application No. 2016-223486 are hereby incorporated by reference herein.

TECHNICAL FIELD

The present disclosure relates to a chair.

BACKGROUND ART

Chairs include a support member, such as a seat body and a backrest to support an occupant. When the support member is formed by a plurality of members, an overlapped state of the plurality of members may be externally visible in an outer peripheral of the support member. For example, a chair disclosed in Patent Document 1 has a seat 12 on a leg 10, resulting in an outer peripheral of the seat 12 in which a part of the leg 10 right under the seat and an outer edge of the seat 12 are stacked together.

Conventionally, chairs with a leg tip attached to a bottom of the leg has been known. The leg tip protects a floor surface from scratches by legs of the chair, and reduces noise of the chair during dragging and moving. For example, Patent Document 1 discloses a chair with a leg tip made of synthetic resin attached to the leg made of a steel pipe.

Conventionally, as disclosed in Patent Document 2, a chair has been known in which a seating board seated by a user of the chair is made of elastomer.

Conventionally, as disclosed in Patent Document 3, a chair has been known in which a central portion of a seating board seated by a user of the chair is elastically deformed.

PRIOR ART DOCUMENTS

Patent Documents

Patent Document 1: Japanese Unexamined Patent Application Publication No. 2010-005285

Patent Document 2: Japanese Unexamined Patent Application Publication No. 2001-327360

Patent Document 3: Japanese Unexamined Patent Application Publication No. 2010-94192

SUMMARY OF THE INVENTION

Problems to be Solved by the Invention

In the chair disclosed in Patent Document 1, the plurality of members are arranged to overlap each other in the outer peripheral of the support member. Due to a thicker outer peripheral of the chair, the chair might deteriorate its fine appearance.

In the chair disclosed in Patent Document 1, the leg tip is attached to the bottom of the steel pipe. Due to the leg tip widely protruding downward from the pipe, the chair might deteriorate its fine appearance.

In the chair disclosed in Patent Document 2, in order to attach the seating board to a support body supporting the seating board, the seating board made of elastomer is directly fastened by a screw. However, since elastomer forming the seating board has high flexibility, the screws tightened to the seating board might be loosened and unintendedly disengaged.

The chair disclosed in Patent Document 3 is directed to an enhanced contact state between a vicinity of user's sciatic and a seating board, thus, a contact state between user's thighs and the seating board is not taken into consideration. This might make the chair uncomfortable depending on the contact state between the thighs and the seating board.

One aspect of the present disclosure is to provide an art to reduce deterioration of fine appearance of a chair.

Another aspect of the present disclosure is to provide a chair in which a seating board is firmly attached.

Still another aspect of the present disclosure is to provide a chair with enhanced comfortability.

Means for Solving the Problems

A first mode of the present disclosure is a chair with following features. The chair includes a support member supporting an occupant, the support member being at least one of a seat body and a backrest. The support member has a composite portion, which is described below, in at least a part of an outer periphery thereof. The composite portion includes a first outer periphery that is a part of a first member, and a second outer periphery that is a part of a second member. The first outer periphery and the second outer periphery are arranged to overlap in a thickness direction of the support member. In the composite portion, at least a part of the first outer periphery is formed into a thin portion thinner in the thickness direction than a part of the first member located on an outside of at least a part of the first outer periphery.

In the chair with this configuration, at least a part of the composite portion is thin due to the thin portion. This reduces deterioration of fine appearance of the chair caused by a large thickness made by stacking a plurality of members.

In the above-described chair, the first member may be configured to have a non-composite portion. The non-composite portion is arranged on an outer periphery of the support member. The non-composite portion is thicker than the thin portion and arranged at a position not to overlap with the second outer periphery in the thickness direction.

In the chair with this configuration, the non-composite portion allows a user to visually and easily recognize that the thin portion in the composite portion is a thin part of the first member. This improves fine appearance of the chair.

In the above-described chair, the thin portion of the first outer periphery may be recessed on a side of the second outer periphery arranged to overlap with the first outer periphery.

In the chair of this configuration, at least a part of the composite portion is configured so that the second outer periphery is housed in the recessed thin portion. This further improves the fine appearance of the chair.

The above-described chair may include a leg member having a length in a top-bottom direction and supporting the support member. Each of the first member and the leg member has a columnar or tubular shape, and they may be connected via a bending bent portion.

In the chair with this configuration, a viewer of the chair can compare the leg member and the thin portion and more clearly recognize that in the composite portion, a portion including a thin portion has a reduced thickness due to the thin portion. This improves the fine appearance of the chair.

In the above-described chair, in addition, the second outer periphery may be arranged on a more occupant's seating side than the first outer periphery.

In the chair with this configuration, the thin portion is formed in the first outer periphery arranged at a position where a body of an occupant is less likely to contact. Thus, the thin portion is less likely to contact the occupant, which gives the occupant less influence caused by the reduced thickness of the thin portion.

A second mode of the present disclosure is a structure body of a chair having a composite portion including a part of a first member and an adjacent portion that is a part of a second member, the adjacent portion being arranged next to the part of the first member. In the composite portion, the part of the first member is formed into a thin portion thinner than an outside portion of the part of the first member in an overlapping direction of the part of the first member and the adjacent portion.

In the structure body of the chair with this configuration, at least a part of the composite portion is thin by the thin portion. This reduces deterioration of fine appearance of the chair caused by a thick composite portion formed by stacking a plurality of members.

A third mode of the present disclosure is a chair including a seat body having a seating surface, and a leg supporting the seat body. The leg includes a columnar portion formed by a member having at least a columnar appearance, the columnar portion being arranged along a floor surface where the chair is placed, and a leg tip attached to the columnar portion and abutting the floor surface. The columnar portion has a recess recessed from a surrounding part of the columnar portion to a direction away from the floor surface. The leg tip is attached to the columnar portion in a state where at least a part of the leg tip is housed in the recess.

In the chair of this configuration, a part of the leg tip is housed in the recess formed on the columnar portion. Thus, a protrusion amount of the leg tip protruding from the columnar portion is small when a non-recessed part in the columnar portion is considered as a reference. This allows the leg tip not to largely protrude from the columnar portion, and reduces deterioration of fine appearance of the chair.

In the above-described chair, the recess may have a bottom surface and a wall surface standing from the bottom surface. The leg tip may be attached to the columnar portion in a state where the leg tip abuts the bottom surface of the recess.

In the chair of this configuration, the leg tip abuts the bottom surface of the recess. This reduces insecurity of the leg tip attached to the columnar portion, resulting in an enhanced stability of the chair.

In the above-described chair, the leg tip may have a contact surface abutting an outer circumferential surface other than the recess in the columnar portion.

In the chair of this configuration, the leg tip abuts the columnar portion on the contact surface, which reduces a looseness and a gap between the leg tip attached to the columnar portion and the columnar portion, resulting in an enhanced stability of the chair.

A fourth mode of the present disclosure is a chair including a seating board and a support body supporting the seating board. The seating board includes a seating portion forming a seating surface and made of at least elastomer, and a first fixing portion fixed to the seating portion and formed by a member with higher rigidity than the seating portion. The support body includes a second fixing portion. The seating board and the support body are fixed by fixing the first fixing portion and the second fixing portion using a specified securing member.

In the chair of this configuration, since the first fixing portion is a member with higher rigidity than the seating surface, stronger fixation can be achieved when the first fixing portion and the second fixing portion are fixed using the securing member, compared with the case where the first fixing portion is made of elastomer, which is the same material of the seating board. Therefore, the seating board can be securely attached to the support body.

In the above-described chair, the seating portion and the first fixing portion may be integrally formed. The integral formation of the seating portion containing elastomer and the first fixing portion reduces a risk of separation between the seating portion and the first fixing portion.

In the above-described chair, the first fixing portion may be formed along an edge of at least a part of the seating portion in a state where the first fixing portion is placed on an undersurface of the seating portion.

With this configuration, deformation of an edge of the seating portion can be reduced by the first fixing portion. In addition, since the first fixing portion is placed under the seating surface, the first fixing portion is less likely to contact a user, thus, the user's discomfort caused by abutting the first fixing portion can be reduced.

In the above-described chair, the first fixing portion may be a frame member formed along an edge of the seating portion with an opening in a center.

With this configuration, deformation of the edge of the seating portion can be reduced by the first fixing portion. In addition, the opening of the first fixing portion ensures an elastic deformation of the seating portion, which reduces deterioration of the sitting comfort.

In the above-described chair, the securing member may be a member having a male screw. The first fixing portion may have a female screw to receive the male screw. The second fixing portion may have a through hole to which the male screw is inserted. The first fixing portion and the second fixing portion may be configured to be fixed by inserting the male screw into the through hole and tightening the male screw to the female screw.

With this configuration, the first fixing portion and the second fixing portion can be firmly fixed by the fastened screw.

In the above-described chair, the first fixing portion may have a front declining portion formed at an end in a first direction of the seating board so as to extend in a second direction crossing the first direction, and the end in the first direction inclines downward.

With this configuration, the end of the seating board in the first direction has a downwardly inclined shape, which improves the user's sitting comfort.

In the above-described chair, the support body may have an edge member that is a tubular or columnar member arranged along an edge of at least a part of the seating portion. The seating board may be configured such that the seating portion covers at least a part of the edge member from above.

With this configuration, the seating portion covers the support body from above. This reduces user's direct contact with the support body and improves user's sitting comfort.

A fifth mode of the present disclosure is a chair including a seating board for a user to be seated. The chair is provided with, in at least a front edge area of the seating board, a front edge portion having at least one of a plate shape and a planar shape, the front edge portion being configured such that a front end of the front edge portion is elastically deformed in a top-bottom direction.

In the chair with this configuration, the front edge portion is elastically deformed in a top-bottom direction. Thus, when the front edge portion receives a user's thighs, the front edge portion supports the thighs while reducing excessive press on the thighs. This improves a contact state between the thighs and the seating board, resulting in an enhanced sitting comfort of the seating board as a whole.

In the above-described chair, one or more slits may be formed in the front edge portion. The chair in this configuration offers adjustable flexibility of the front edge portion due to the slits.

In the above-described chair, at least a part of an upper surface of the front edge portion may be covered by elastomer. The chair in this configuration reduces discomfort at the time of direct contact of a human body with the front edge portion.

In the above-described chair, the seating board may be provided with a displacement restriction located in a rear of the front edge portion, the displacement restriction being less elastically deformed in a top-bottom direction than the front edge portion. In addition, the front edge portion and the displacement restriction may be formed by a common member. The chair in this configuration reduces entire sinking of a wide range of the front portion of the seating board when a user is seated.

In the above-described chair, a width in a left-right direction of the front edge portion may be configured to be smaller than a width in the displacement restriction in the left-right direction. The chair in this configuration reduces an elastic deformation in the rear of the front edge portion without significantly interfering an elastic deformation of the front edge portion.

In the above-described chair, the front edge portion may be configured to have a substantially rectangular shape having a length in the left-right direction when seen from above. The chair in this configuration can widen a surface supporting user's thighs in the left-right direction.

In the above-described chair, the front edge portion may have a shape inclined downward toward a front. The chair in this configuration provides enhanced sitting comfort since a load on user's thighs reduces toward the front.

BRIEF DESCRIPTION OF THE DRAWINGS

FIG. 1 illustrates a chair according to an embodiment.

FIG. 2A and FIG. 2B are exploded perspective views of only a seating board and a framework. FIG. 2A and FIG. 2B are perspective views seen from different directions.

FIG. 3 is a perspective view of the seating board and the leg tip attached to the framework.

FIG. 4 illustrates the seating board of the chair according to the embodiment in FIG. 1A to FIG. 1G.

FIG. 5 illustrates the seating board of the chair according to the embodiment in FIG. 1A to FIG. 1G.

FIG. 16 illustrates sectional views seen from the same cross section as FIG. 1F.

EXPLANATION OF REFERENCE NUMERALS

Figure 1D:
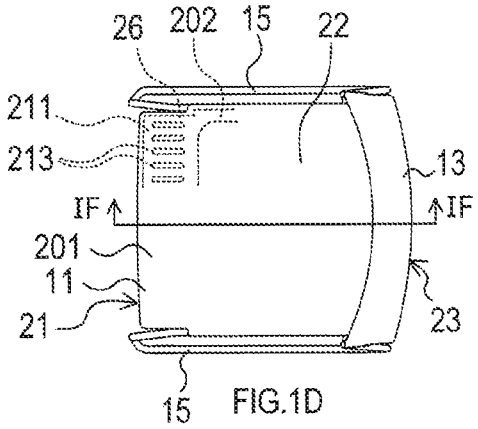
FIG. 1D is a plan view.
Figure 1E:
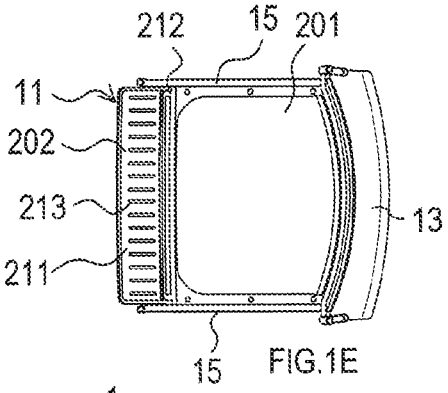
FIG. 1E is a sectional view taken along line IE-IE in FIG. 1A.
Figures 1A, 1B, 1C:
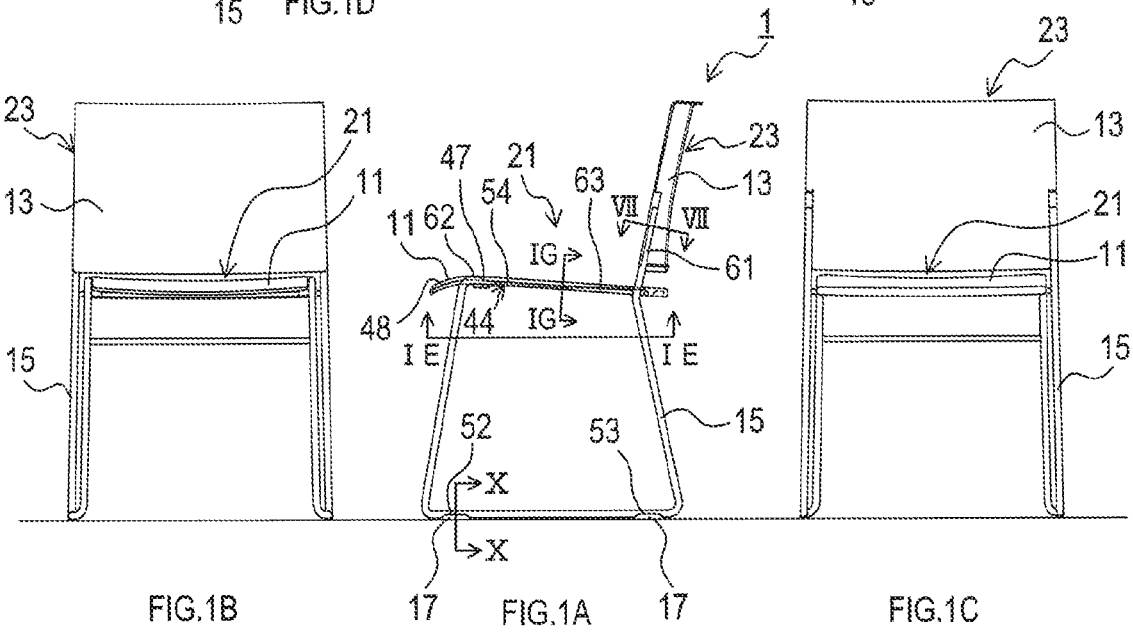
FIG. 1A is a side view.
FIG. 1B is a front view.
FIG. 1C is a rear view.

1 . . . chair, 11 . . . seating board, 13 . . . back board, 15 . . . framework, 17 . . . leg tip, 21 . . . seat body, 22 . . . seating surface, 23 . . . backrest, 24 . . . side frame, 25 . . . rear frame, 26 . . . front frame, 27 . . . opening, 28 . . . protrusion, 29 . . . groove, 31 . . . pipe body, 32 . . . front joining bar, 33 . . . rear joining bar, 34 . . . second fixing portion, 41 . . . front support, 42 . . . rear support, 43 . . . lower support, 44 . . . upper support, 46 . . . bent portion, 47 . . . step, 48 . . . first outer edge, 49 . . . second outer edge, 52 . . . recess, 53 . . . recess, 54 . . . recess, 55 . . . side portion, 56 . . . front portion, 57 . . . through hole, 58 . . . screw hole, 61 . . . thin portion, 62 . . . thick portion, 63 . . . thin portion, 65 . . . screw member, 71 . . . seating body composite portion, 73 . . . backrest composite portion, 74 . . . end, 81 . . . columnar body, 82 . . . plane, 83 . . . through hole, 84 . . . slope, 85 . . . groove, 86 . . . lower end surface, 91 . . . bottom surface, 92 . . . wall surface, 93 . . . screw hole, 95 . . . screw, 101 . . . seating body composite portion, 103 . . . side surface portion, 105 . . . seating body composite portion, 107 . . . side surface portion, 111 . . . seating body composite portion, 113 . . . side surface portion, 121 . . . seating body composite portion, 123 . . . side surface portion, 125 . . . thin portion, 131 . . . seating body composite portion, 132 . . . thin portion, 133 . . . thick portion, 134 . . . thick portion, 135 . . . side surface portion, 141 . . . leg tip, 143 . . . contact surface, 201 . . . seating portion, 202 . . . first fixing portion,

211 . . . front edge portion, 211*a* . . . front edge portion, 212 . . . displacement restriction, 213 . . . slit, 214 . . . auxiliary step, 221 . . . groove, 222 . . . end wall, 223 . . . inner wall, 225 . . . projection, 231 . . . slit, 232 . . . expansion, 233 . . . cover, 234 . . . cover, 235 . . . cover, 241 . . . through hole, 251 . . . slit

MODE FOR CARRYING OUT THE INVENTION

Hereinafter, embodiments of the present disclosure will be described with reference to the drawings.

1. Embodiment

[1-1. Overall Configuration]

As shown in FIG. 1, a chair 1 includes a seating board 11, a back board 13, a framework 15, and a leg tip 17.

In the present embodiment, directions such as front and rear, left and right, and top and bottom may be used to describe configurations of each component. It should be understood that those directions are used only for easy understanding of the description and not for any limitations for embodiments of the present disclosure. The above-described directions are founded based on an occupant who is normally seated on the chair 1.

The chair 1 is symmetrical. In the chair 1, a seat body 21 is formed by a part of the framework 15 and the seating board 11, and a backrest 23 is formed by a part of the framework 15 and the back board 13.

[1-2. Framework 15]

Figure 2A:
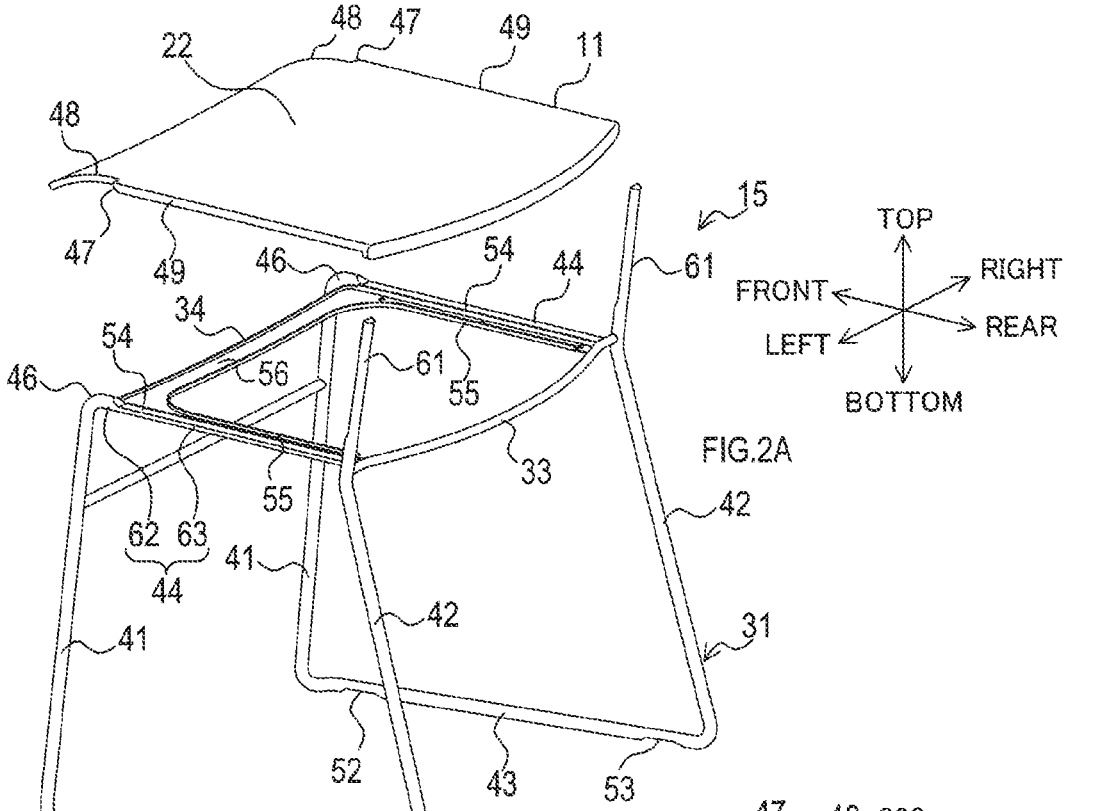
FIG. 2A and FIG. 2B illustrate the chair according to the embodiment in FIG. 1A to FIG. 1G (a back board and a leg tip are omitted). That is.
Figure 2B:
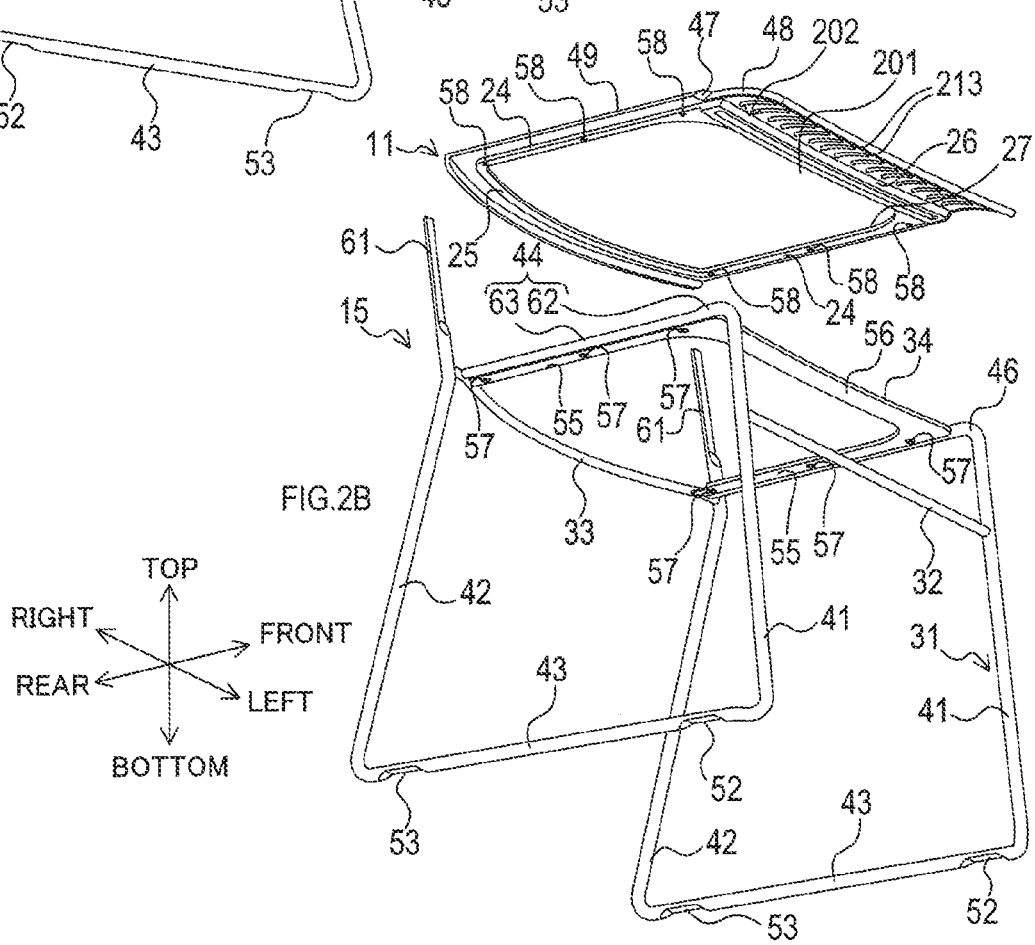
Figure 3:
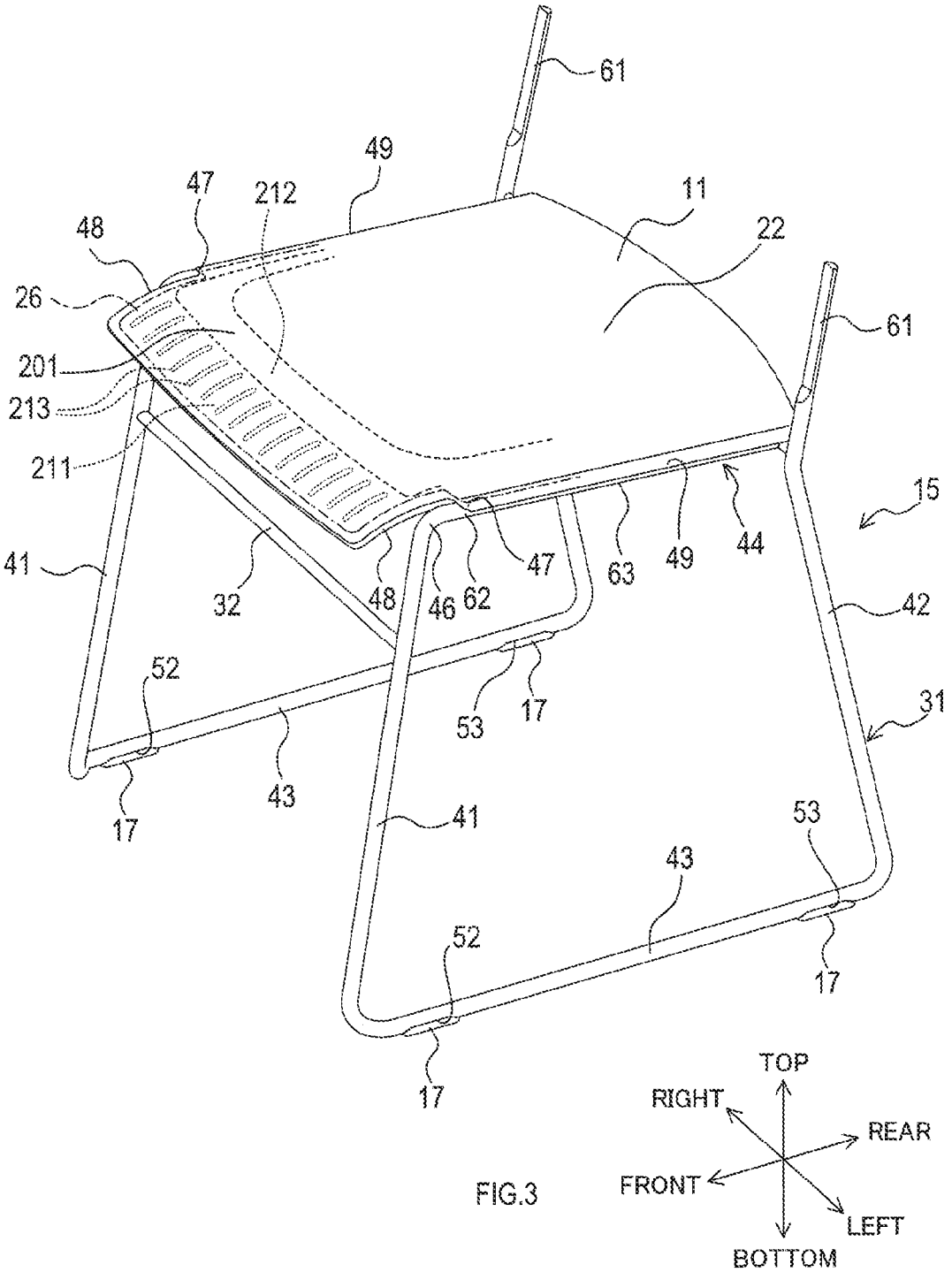
FIG. 3 illustrates the chair according to the embodiment in FIG. 1A to FIG. 1G (the back board is omitted). That is.

As shown in FIG. 2A, FIG. 2B, and FIG. 3, the framework 15 includes a pair of left and right pipe bodies 31 formed by a cylindrical, tubular metal pipe being bent and welded. The framework 15 also includes a front joining bar 32 and a rear joining bar 33 to connect the pipe bodies 31, and a second fixing portion 34 attached between the pipe bodies 31.

The pipe body 31 includes a front support 41, a rear support 42, a lower support 43, and an upper support 44.

The front support 41 is located in the front of the pipe body 31 and has a length in a top-bottom direction.

The rear support 42 is located in the rear of the pipe body 31 and has a length in the top-bottom direction. At the top of the rear support 42, a thin portion 61 is formed.

The thin portion 61 is formed thinner than an outside part of the thin portion 61 in the rear support 42. That is, the thin portion 61 is formed thinner than a lower part of the thin portion 61 in the rear support 42. The outside part of the thin portion 61 can be paraphrased as a surrounding part of the thin portion 61 in the rear support 42 or an adjacent part of the thin portion 61 in the rear support 42.

The lower support 43 is located at a bottom of the pipe body 31 and connects a lower end of the front support 41 and a lower end of the rear support 42. The lower support 43 is a member having columnar appearance and placed along a floor surface where the chair 1 is placed. The member having columnar appearance means that the member may be hollow or non-hollow. In the present embodiment, the lower support 43 is hollow.

On a lower surface of the lower support 43, there are two recesses, a recess 52 and a recess 53 recessed in a direction away from the floor surface than a surrounding part of the recesses, that is, recessed upward. The recess 52 and the recess 53 are arranged apart from each other in a front-rear direction.

The upper support 44 is located in an upper part of the pipe body 31 and connects an upper end of the front support 41 and an upper middle of the rear support 42. The front support 41 and the upper support 44 are connected via a bent portion 46 formed by bending a metal pipe. A rear end of the upper support 44 is connected to the rear joining bar 33 by welding. The upper support 44 has a thick portion 62 and a thin portion 63, and the thick portion 62 is located in front of the thin portion 63. The upper support 44 is arranged along each of left and right edges of a seating portion 201, which is described below.

The thick portion 62 has a same diameter as other parts of the pipe body 31. On the other hand, the thin portion 63 is formed to be thinner than the thick portion 62 due to a recess 54 formed on an upper surface of the upper support 44 so as to be recessed downward. The thick portion 62 is an outside part of the thin portion 63 in the upper support 44. Here, the term "outside" means an outside relative to a length direction of the upper support 44. The term "outside" may also mean an outside relative to a direction along an outer periphery of a seat body 21, which is described below. The outside part of the thin portion 63 can be paraphrased as a surrounding part of the thin portion 63 in the upper support 44, or an adjacent part of the thin portion 63 in the upper support 44.

The front joining bar 32 connects the front support 41 of a left pipe body 31 and the front support 41 of a right pipe body 31. The rear joining bar 33 connects the rear support 42 of a left pipe body 31 and the rear support 42 of a right pipe body 31.

The second fixing portion 34 is a plate member with bending process around its peripheral edge. The second fixing portion 34 includes a pair of left and right side portions 55 arranged along a pair of left and right upper supports 44, and a front portion 56 connecting front ends of the side portions 55.

Figure 1F:
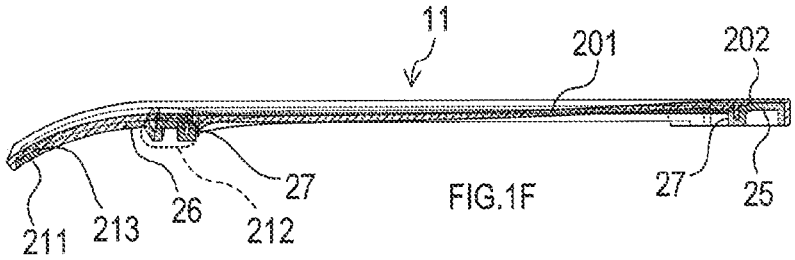
FIG. 1F is a sectional view taken along line IF-IF in FIG. 1D (configurations other than a seating board are omitted)
Figure 1G:
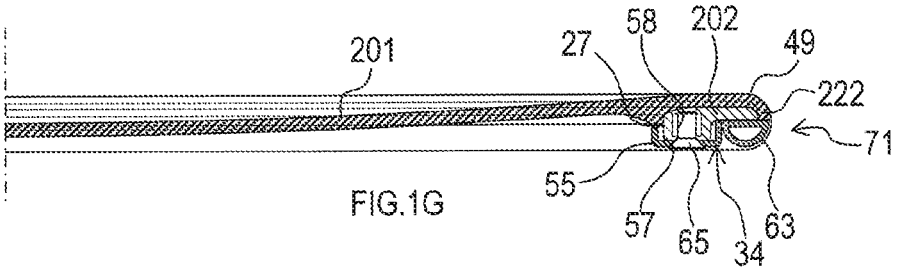
FIG. 1G is a sectional view taken along line IG-IG in FIG. 1A.

The pair of side portions 55 is welded to the pair of upper supports 44, thus, the second fixing portion 34 is fixed to the pair of upper supports 44. As shown in FIG. 2B, each of the left and right side portions 55 has three through holes 57 formed apart from each other in the front-rear direction. Into each through hole 57, a male screw of a screw member 65, which is described below, can be inserted. There are also screw holes 58 formed at positions corresponding to the through holes 57 on an underside of the seating board 11. As shown in FIG. 1G, the seating board 11 is fixed to the framework 15 by inserting the screw member 65 into the through hole 57 and tightening it to the screw hole 58.

The front portion 56 is located behind the bent portion 46.

[1-3. Seating Board 11]

A seating board 11 is a member for a user to be seated, and includes a seating portion 201 and a first fixing portion 202 as shown in FIG. 1F, FIG. 2B, FIG. 4A and FIG. 4B.

The seating portion 201 configures a seating surface 22 on its top, and the seating portion 201 is formed by elastomer. The elastomer means an elastic polymeric material.

The seating board 11 has a substantially rectangular plate shape as a whole and a front portion thereof forms a curved surface gently bending downward.

Figure 4A:
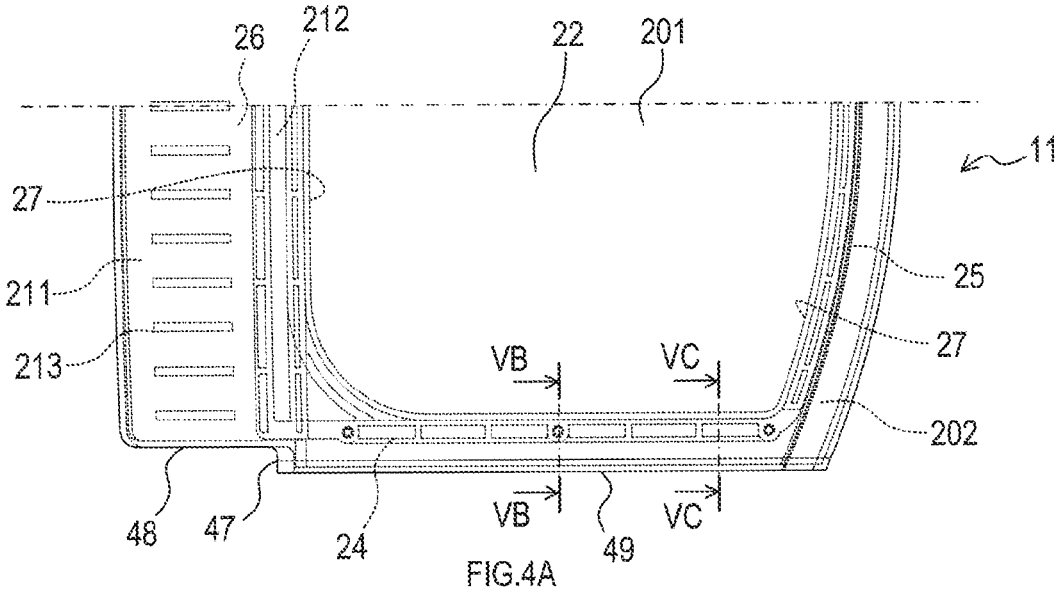
FIG. 4A is a plan view.
Figure 4B:
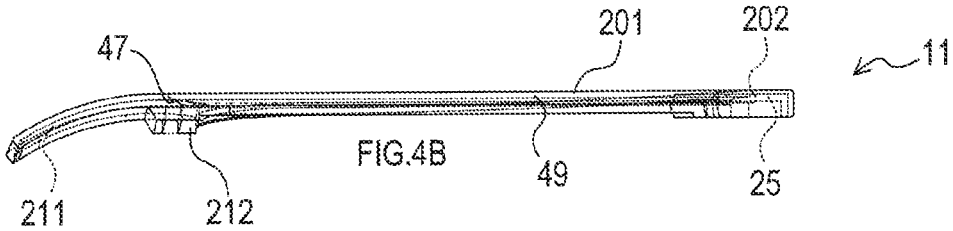
FIG. 4B is a side view.

As shown in FIG. 2A, FIG. 3, FIG. 4A, and the like, the seating portion 201 of the seating board 11 has a width in a left-right direction, and the width is formed to be wider in the rear and narrower in the front using a step 47 as a boundary, the step 47 being formed near the front on each of the left and right sides. When seen from the left or right side, the step 47 has an inclined front surface that tilts toward the front. In the left and right edges of the seating board 11, a front portion before the step 47 is referred to as a first outer edge 48 and a rear portion after the step 47 is referred to as a second outer edge 49. When seen from the left or right side, the step 47 has an inclined front surface that tilts toward the front.

Figure 4C:
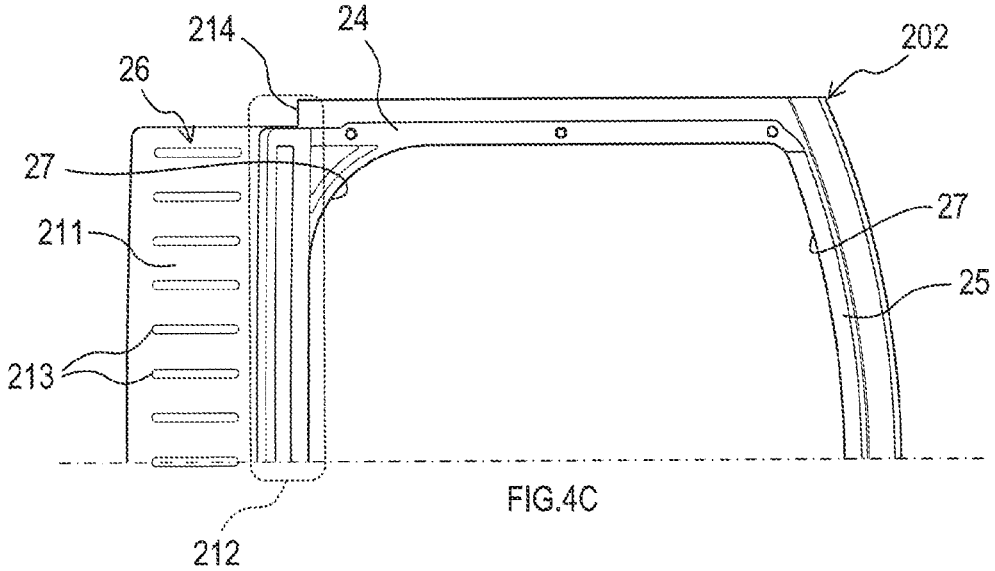
FIG. 4C is a bottom view of a first fixing portion.

The first fixing portion 202 is, as shown in FIG. 2B and FIG. 4C, a substantially rectangular frame member. The first fixing portion 202 includes a pair of side frames 24, a rear frame 25, and a front frame 26. Each of the side frames 24 is arranged along each of the left and right edges of the seating portion 201. The rear frame 25 is arranged along a rear edge of the seating portion 201 and connects rear ends of the side frames 24. The front frame 26 is arranged along a front edge area of the seating portion 201 and connects the front ends of the side frames 24.

The front frame 26 is formed to expand to left and right at a front end of the seating board 11. The front frame 26 is provided with, in a front portion of the front frame 26, that is, in a front edge area of the seating board 11, a front edge portion 211 configured such that a front end is elastically deformed in the top-bottom direction.

The front frame 26 is also provided with a displacement restriction 212 in a rear portion thereof, that is, in a rear position of the front edge portion 211. In other words, the front edge portion 211 and the displacement restriction 212 are formed by a common member. The displacement restriction 212 abuts the front portion 56 and is supported from the bottom by the front portion 56. Thus, the displacement restriction 212 is less elastically deformed in the top-bottom direction than the front edge portion 211.

The front edge portion 211 has a plate shape. The front edge portion 211 has a substantially rectangular shape having a length in the left-right direction when seen from above. The front edge portion 211 has a shape inclined downward toward the front. A front portion of the seating portion 201 forms a curved surface along the front edge portion 211.

A plurality of slits 213 is formed in the front edge portion 211. The slits 213 have a length in the front-rear direction and arranged in the left-right direction.

Since an outer peripheral shape of the first fixing portion 202 is formed so as to correspond to an outer peripheral shape of the seating portion 201, as shown in FIG. 4C, the first fixing portion 202 is formed to be wider in the rear and narrower in the front using an auxiliary step 214, which has a step shape like the step 47 of the seating portion 201. Thus, the front edge portion 211 has a width in the left-right direction smaller than a width in the left-right direction in a rear portion of the displacement restriction 212.

As described above, the front portion 56 is located behind the bent portion 46. Thus, the displacement restriction 212 is located behind the bent portion 46. On the other hand, the front edge portion 211 widely protrudes to the front than the bent portion 46 as shown in FIG. 3.

The first fixing portion 202 has an opening 27 formed in a center thereof. Here, the center means a central portion of the first fixing portion 202 when the first fixing portion 202 is considered as a frame, that is, the center means an inside of the frame. The first fixing portion 202 is fixed to the seating portion 201 in a state where the first fixing portion 202 is placed on an under surface of the seating portion 201. The opening 27 is entirely covered by the seating portion 201.

The first fixing portion 202 is formed by a member with higher rigidity than the elastomer forming the seating portion 201. Examples of a material to be used for the first fixing portion 202 may include: for example, an olefin based resin such as polypropylene; a synthetic resin such as polyamide; fiber reinforced plastics containing glass fibers, carbon fibers and the like; or materials other than resins such as metal or wood. However, the material may not be limited to the above. The rigidity is a degree of not being deformed under forces of bending and twisting.

The seating portion 201 and the first fixing portion 202 are integrally formed by a two-color molding. Specific examples of the manufacturing process may include, for example, replacing molds in one injection molding machine to form the seating portion 201 and the first fixing portion 202 continuously and sequentially, or setting the molded first fixing portion 202 inside a mold to form the seating portion 201. When a metal member instead of a resin member is used for the first fixing portion 202, the latter process, so-called an insert molding, may be used for the integral formation.

As shown in FIG. 4A, the seating portion 201 entirely covers the first fixing portion 202 when seen from above. In the front edge portion 211, an upper surface thereof is also entirely covered by the elastomer. As shown in FIG. 1F, the elastomer forming the seating portion 201 enters inside the slits 213.

Figure 5A:
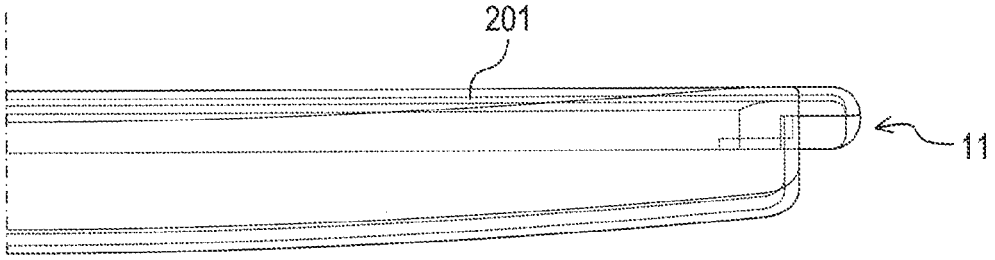
FIG. 5A is a front view.
Figure 5B:
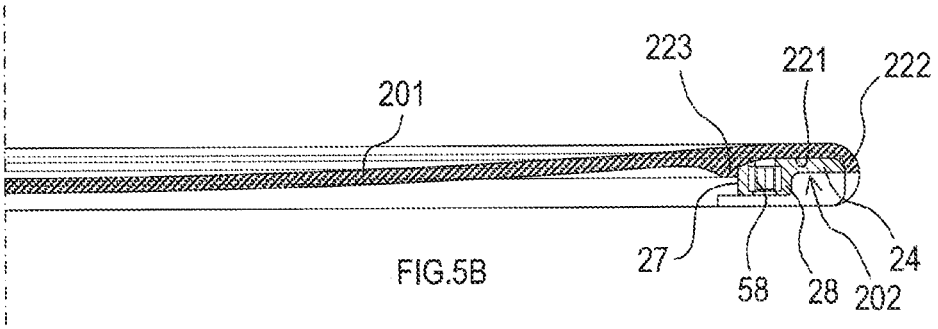
FIG. 5B is a sectional view taken along line VB-VB in FIG. 4A.
Figure 5C:
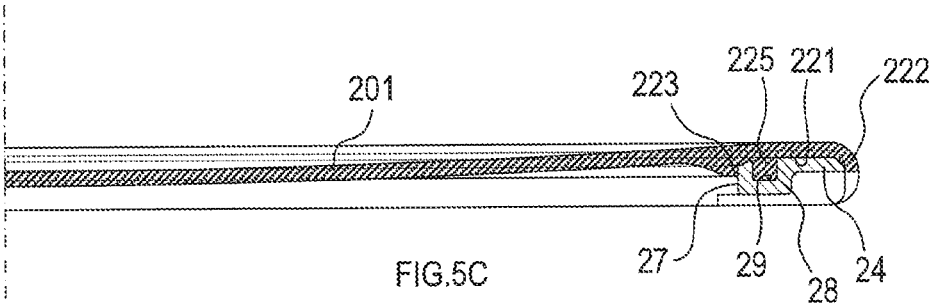
FIG. 5C is a sectional view taken along line VC-VC in FIG. 4A.

As shown in FIG. 5B and FIG. 5C, the side frame 24 is formed so as to fit into a groove 221 recessed upward and formed in the vicinity of left and right edges of the seating portion 201. The groove 221 is formed by an end wall 222 bending and extending downward at the left and right ends of the seating portion 201, and an inner wall 223 that is a downward projection formed at a position spaced from the ends. The side frame 24 arranged inside the groove 221 is held from the left and right by the end wall 222 and the inner wall 223.

The side frame 24 has a protrusion 28 protruding downward. As shown in FIG. 5B, the screw hole 58 is formed in the protrusion 28. The screw hole 58 is formed at a position corresponding to the through hole 57 of the side portion 55 of the second fixing portion 34.

In an area where the screw hole 58 is not formed in the side frame 24, as shown in FIG. 5C, a groove 29 recessed downward is formed. Into the groove 29, a projection 225 formed in the seating portion 201 is inserted.

As shown in FIG. 1G, the first fixing portion 202 and the side portion 55 are fixed by inserting the screw member 65 into the through hole 57 of the side portion 55 of the second fixing portion 34 and tightening it to the screw hole 58. When the first fixing portion 202 and the second fixing portion 34 are fixed, a bottom end of the protrusion 28 abuts an upper surface of the side portion 55.

In this state, as shown in FIG. 1G and FIG. 3, the second outer edge 49 of the seating portion 201 covers not only the first fixing portion 202, but also the thin portion 63 of the upper support 44 from above. In other words, in a range of the second outer edge 49 formed behind the step 47 in the front-rear direction, the seating portion 201 covers an entire area of the thin portion 63 and the side portion 55 in the left-right direction, resulting in a state where the thin portion 63 and the side portion 55 are invisible when seen from above.

In the upper support 44, the thick portion 62 is arranged on an outer periphery of the seating board 11 at a position not to overlap with the seating portion 201 in a thickness direction of the seating board 11.

[1-4. Seat Body 21 and Backrest 23]

A seat body 21 includes the seating board 11, the second fixing portion 34, and the upper support 44. The seat body 21 has a seating surface 22.

Figure 6:
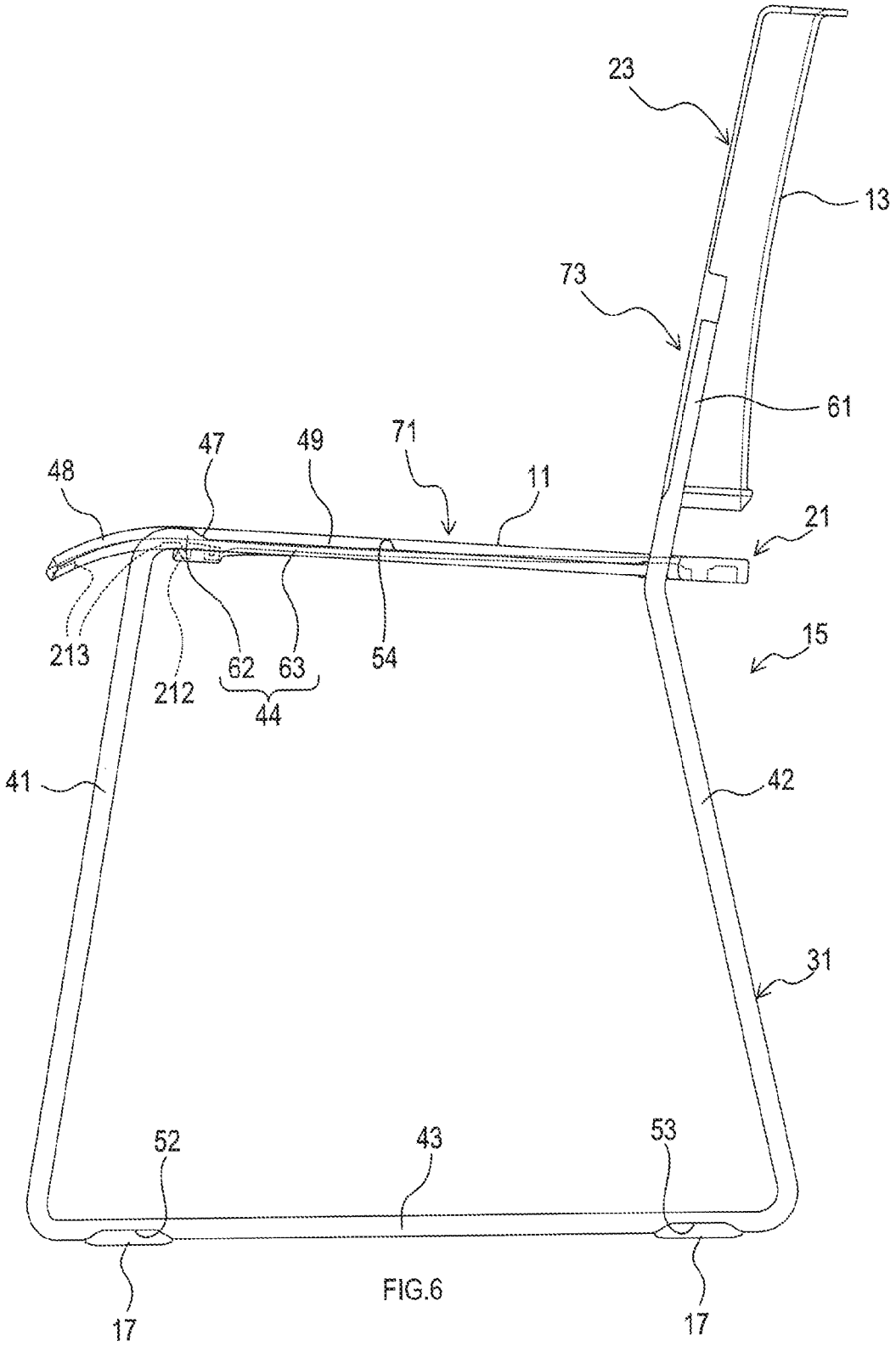
FIG. 6 is a side view of the chair and an enlarged view of FIG. 1A.

In a state where the seating board 11 is fixed to the framework 15, as shown in FIG. 1G and FIG. 6, the second outer edge 49 is arranged so as to be stacked together with the thin portion 63 in the top-bottom direction to configure a seating body composite portion 71. The seating body composite portion 71 will be described in detail below.

Figure 7:
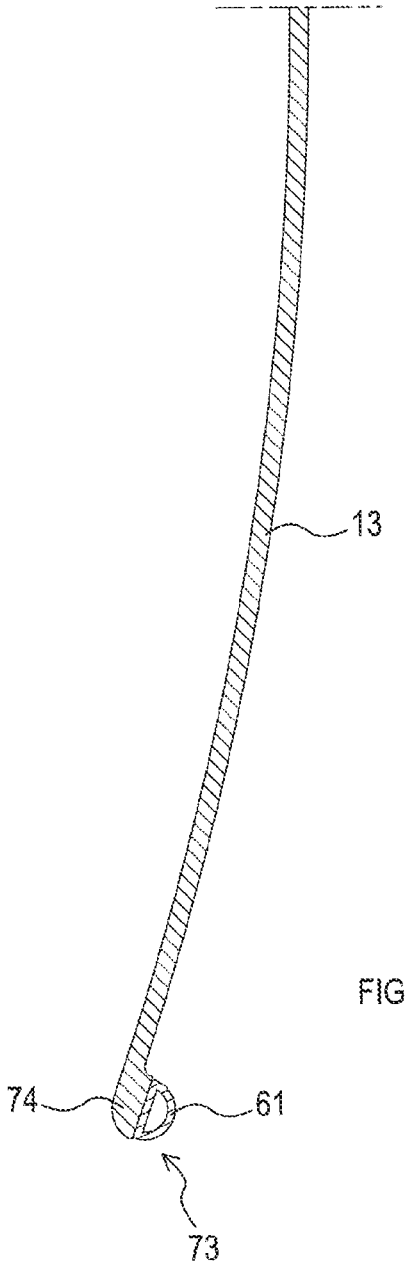
FIG. 7 is a sectional view taken along line VII-VII in FIG. 1A.

A backrest 23 includes, as shown in FIG. 6, the thin portion 61 and the back board 13. In a state where the back board 13 is fixed to the framework 15, as shown in FIG. 7, the back board 13 and the thin portion 61 are arranged so as to be stacked in the front-rear direction at each of the left and right ends 74 of the back board 13 to configure a backrest composite portion 73. The backrest composite portion 73 will be described in detail below.

The seat body 21 and the backrest 23 both support an occupant.

The seat body 21 is supported by the front support 41, the rear support 42, and the lower support 43.

[1-5. Seating Body Composite Portion 71 of Seat Body 21]

As shown in FIG. 1G and FIG. 6, the seat body 21 has the seating body composite portion 71 in a part of each of the left and right side surfaces of an outer periphery of the seat body 21.

The seating body composite portion 71 includes the thin portion 63 that is a part of the upper support 44 and the second outer edge 49 that is a part of the seating board 11. The thin portion 63 and the second outer edge 49 are overlapped in a thickness direction of the seat body 21, that is, in the present embodiment, approximately in the top-bottom direction.

Since the thin portion 63 has the recess 54, the thin portion is thinner than the thick portion 62 in the thickness direction of the seat body 21. The thin portion 63 is recessed on a side of the second outer edge 49 arranged to overlap with the thin portion 63.

The second outer edge 49 is arranged on a more occupant's seating side than the thin portion 63.

In the seating body composite portion 71 with this configuration, a thickness formed by the thin portion 63 and the second outer edge 49 has a substantially same size as a diameter of the thick portion 62. As shown in FIG. 1G, when a cross section of the seating body composite portion 71 is seen from the front, each of the left and right outer ends of the second outer edge 49 has a rounded top. Thus, when stacking each of the left and right outer ends of the second outer edge 49 on the thin portion 63 having a rounded bottom, a cylindrical surface extending in the front-rear direction is formed.

The seating body composite portion 71 is formed by stacking two members of the seating board 11 and the upper support 44; however, a thickness of the seating body composite portion 71 falls within the same thickness of the thick portion 62 of the upper support 44, which is one of the two members, and the surface of the seating body composite portion 71 has a virtual cylindrical shape similar to the thick portion 62. Thus, the seat body 21 achieves excellent fine appearance due to a sense of unity created by forming a part of the seating body composite portion 71 into a cylindrical shape similar to the thick portion 62, the bent portion 46, and the front support 41.

In addition, since the seating board 11 is arranged on a more upper side than the upper support 44, the seating board 11 extends to both ends in the left-right direction of the seat body 21. Thus, the seating board 11 provides a wider area for an occupant to be seated without receiving discomfort.

In the upper support 44, the thick portion 62 is arranged on an outer periphery of the seat body 21, and the thick portion 62 is thicker than the thin portion 63, and the thick portion 62 is arranged at a position not to overlap with the second outer edge 49 in the thickness direction of the seat body 21.

[1-6. Backrest Composite Portion 73 of Backrest 23]

As shown in FIG. 6 and FIG. 7, the backrest 23 has the backrest composite portion 73 in a part of each of the left and right side surfaces of the outer periphery of the backrest 23.

The backrest composite portion 73 includes the thin portion 61 that is a part of the rear support 42 and an end 74 that is a part of the back board 13. The thin portion 61 and the end 74 are arranged to overlap in a thickness direction of the backrest 23, that is, in the present embodiment, in the substantially front-rear direction.

In the backrest composite portion 73, the thin portion 61 is thinner in a thickness direction of the backrest 23 than an outside portion of the thin portion 61 in the rear support 42. The thin portion 61 is recessed on a side of the end 74 arranged to overlap with the thin portion 61. The end 74 is arranged on a more occupant's seating side than the thin portion 61.

In the backrest composite portion 73 with this configuration, a thickness formed by the thin portion 61 and the end 74 has a substantially same size as a diameter of the rear support 42. As shown in FIG. 7, when a cross section of the backrest composite portion 73 is seen from above, the end 74 has each of the left and right outer ends rounded on the front. Thus, when stacking each of the left and right outer ends of the end 74 and the thin portion 61 having a rounded rear, a cylindrical surface extending in the top-bottom direction is formed.

The backrest composite portion 73 is formed by stacking two members of the back board 13 and the rear support 42; however, a thickness of the backrest composite portion 73 falls within the same thickness of the rear support 42, which is one of the two members, and a surface of the backrest composite portion 73 has a virtual cylindrical shape similar the rear support 42. Thus, the backrest 23 achieves excellent fine appearance due to a sense of unity created by forming a part of the backrest composite portion 73 into a cylindrical shape similar to the rear support 42 located below.

In addition, since the back board 13 is arranged on a more upper side than the thin portion 61, the back board 13 extends to both ends in the left-right direction of the backrest 23, resulting in providing a wider area for an occupant to be supported from the rear without receiving discomfort.

[1-7. Leg Tip 17 and Lower Support 43]

Figure 8:
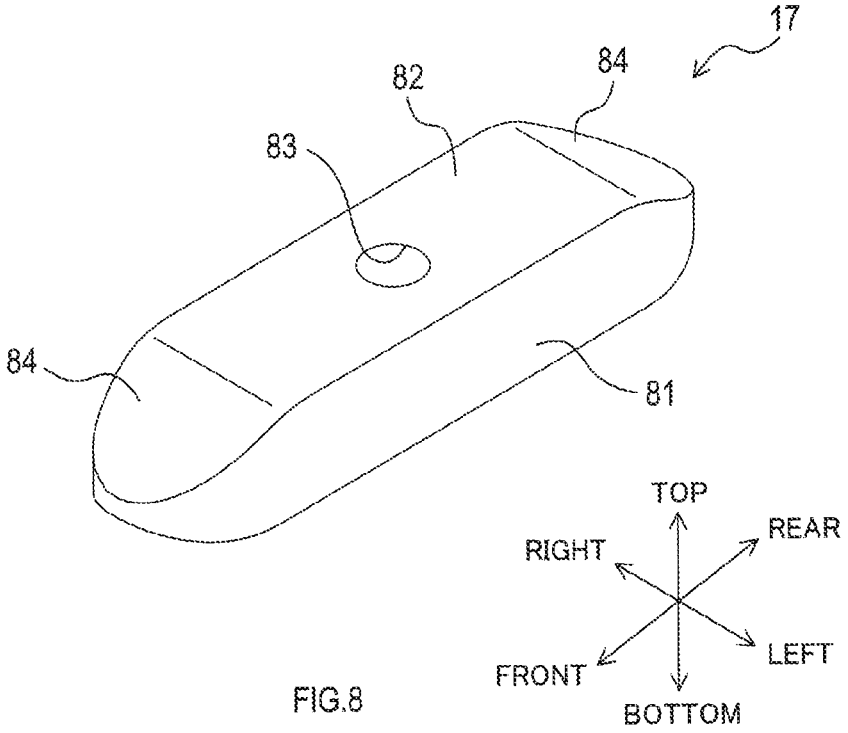
FIG. 8 is a perspective view of the leg tip of the chair according to the embodiment in FIG. 1A to FIG. 1G.

As shown in FIG. 8, the leg tip 17 includes a columnar body 81 having a length in the front-rear direction. Among surfaces of the columnar body 81, a top surface is a plane 82. The plane 82 has a through hole 83 formed in a central portion thereof and penetrating to a back of the columnar body 81. The columnar body 81 has a slope 84 formed on each of an upper front end and an upper rear end of the columnar body, and each of the slopes 84 inclines downward toward the front and rear ends.

Figure 9:
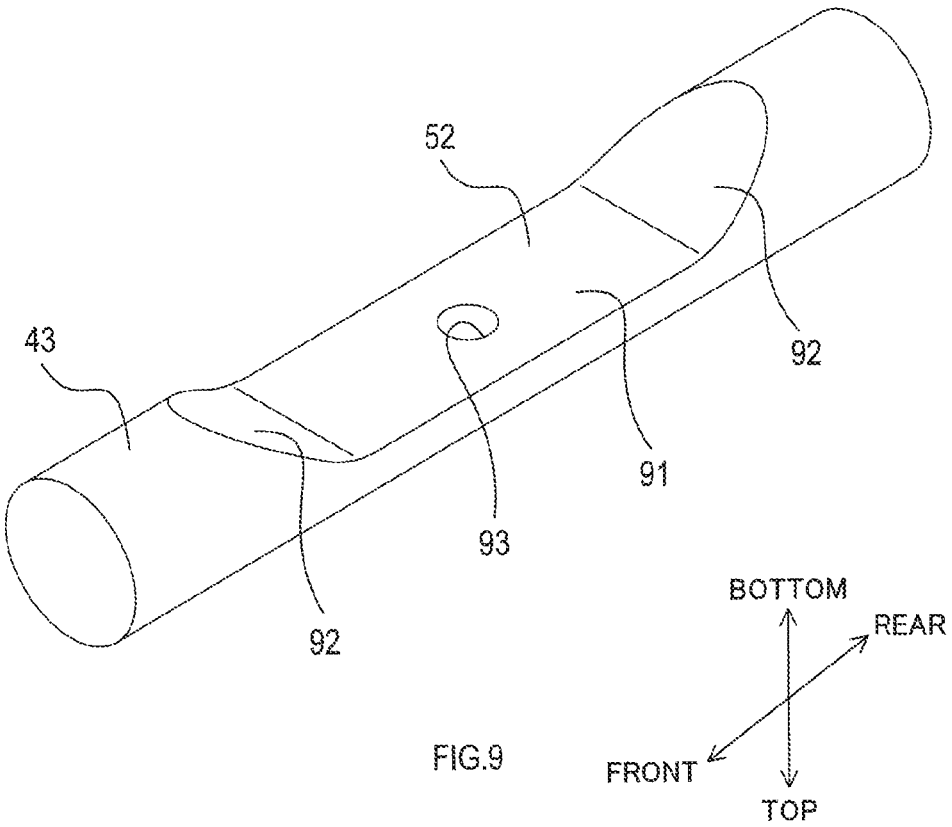
FIG. 9 is a perspective view of a recess formed on a lower support of the chair according to the embodiment in FIG. 1A to FIG. 1G.

The recess 52 formed in the lower support 43 has, as shown in FIG. 9, a plane bottom surface 91 located on an inner most surface of the recess 52, and a wall surface 92 that is a slope standing from each of front and rear ends of the bottom surface 91. The bottom surface 91 has a screw hole 93 formed in a central portion thereof. Here, the bottom surface refers to a surface located in an inner part of the recess, in other words, a surface located on an upper side when using the chair 1 as a reference.

In a state where the leg tip 17 is attached to the recess 52, the plane 82 abuts the bottom surface 91 and the slopes 84 abut the wall surfaces 92. In this way, the leg tip 17 abuts the recess 52 by a plurality of surfaces.

Figure 10:
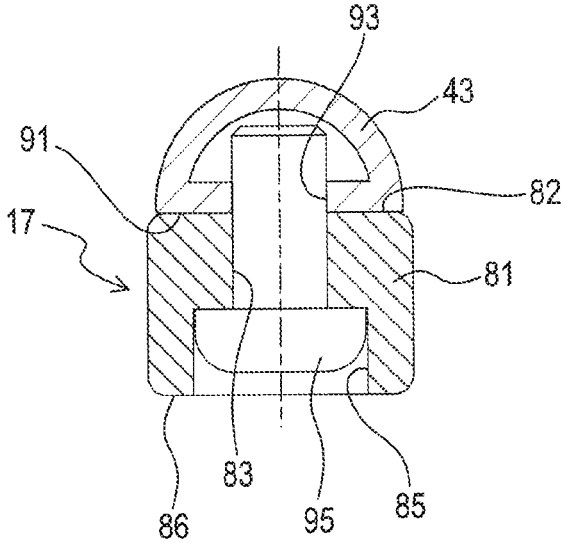
FIG. 10 is a sectional view taken along line X-X in FIG. 1A.

As shown in FIG. 10, the columnar body 81 has a groove 85 formed on a lower end surface 86 that is an opposite surface of the plane 82. The lower end surface 86 is a surface abutting a floor. The groove 85 is connected to the through hole 83, and the leg tip 17 is attached to the lower support 43 by inserting a screw 95 from the groove 85 into the through hole 83 and tightening it to the screw hole 93. At this time, the leg tip 17 is attached to the lower support 43 in a state where at least a part of the leg tip 17 is housed in the recess 52.

The recess 52 and the recess 53 have the same shape and the leg tips 17 attached thereto also have the same shape.

[1-8. Effects]

According to the embodiment described above, the following effects can be obtained.

[1A-1] In the chair 1, the second outer edge 49 and the thin portion 63 configure the seating body composite portion 71, and the thickness of the seating body composite portion 71 is configured to have a substantially same size as the thickness of the thick portion 62. This reduces deterioration of fine appearance caused by an increased thickness of the seating body composite portion 71 and improves fine appearance.

[1A-2] In the seating body composite portion 71, the thin portion 63 is recessed downward and the second outer edge 49 is arranged on the recess. Thus, the seating body composite portion 71 has a same height as the thick portion 62, which creates a sense of unity between the upper support 44 and the seating board 11, resulting in enhanced fine appearance.

[1A-3] In the chair 1, the upper support 44 and the front support 41 are connected via the bent portion 46 and they are visually recognized to be formed by a common member. This provides clear visual recognition that the thin portion 63 is thinner than the front support 41, and signifies an originality of a design created by forming a thin portion in a part of the pipe body 31.

[1A-4] In the chair 1, the second outer edge 49 is arranged on a more occupant's side than the thin portion 63. Thus, an occupant is less likely to feel uncomfortable with the outer peripheral of the seating surface 22, which reduces deterioration of sitting comfort.

[1A-5] In the chair 1, the same effect as described in the above-[1A-1] to [1A-4] can be achieved in the backrest composite portion 73. That is, arranging the thin portion 61 and the end 74 to overlap each other reduces an increased thickness and improves fine appearance, and arranging the thin portion 61 behind the end 74 reduces deterioration of leaning comfort of the backrest 23.

[1B-1] In the chair 1, a part of the leg tip 17 is housed in each of the recess 52 and the recess 53 in the lower support 43. Thus, when a non-recessed part of the lower support 43 is used as a reference, a protrusion amount of the leg tip 17 projected from the lower support 43 is small. This reduces a large protrusion of the leg tip 17 from a columnar portion, and reduces deterioration of fine appearance.

[1B-2] In the chair 1, the plane 82 of the leg tip 17 abuts the bottom surface 91 of each of the recess 52 and the recess 53, and the slope 84 abuts the wall surface 92. This reduces looseness and a gap between the leg tip 17 attached to the lower support 43 and the lower support 43, thus, an enhanced stability of the chair 1 can be obtained.

[1C-1] In the chair 1, the first fixing portion 202 is a member with higher rigidity than the seating portion 201, and thus the first fixing portion 202 and the second fixing portion 34 can be firmly fixed by the screw member 65. Thus, the seating board 11 can be securely attached to the framework 15.

[1C-2] The seating board 11 is formed by the seating portion 201 containing elastomer and the first fixing portion 202 integrally formed by a two-color molding, which reduces a risk of separation between the seating portion 201 and the first fixing portion 202.

[1C-3] In the chair 1, the first fixing portion 202 has a frame shape arranged along an edge of the seating portion 201, which reduces deformation of the edge of the seating portion 201. In addition, the seating portion 201 is ensured to be elastically deformed due to the opening 27 of the first fixing portion 202. This achieves reduced deterioration of sitting comfort caused by the first fixing portion 202.

[1C-4] In the chair 1, the first fixing portion 202 is stacked under the seating portion 201, which makes the first fixing portion 202 less likely to contact a seated user, thus, user's discomfort caused by abutting the metal framework 15 can be reduced.

[1C-5] In the chair 1, the first fixing portion 202 is provided with the front edge portion 211 whose front end is inclined downward, thus, sitting comfort improves. In addition, the front edge portion 211 is covered by the seating portion 201, which reduces user's discomfort at the time in contact with the relatively hard first fixing portion 202.

[1C-6] In the chair 1, the second outer edge 49 of the seating portion 201 covers the thin portion 63 from above. This reduces user's direct contact with the framework 15 and improves user's sitting comfort.

[1D-1] In the chair 1, the front edge portion 211 elastically deforms in the top-bottom direction, which enables the front edge portion 211 to support user's thighs so as not to excessively press the thighs when the thighs are placed on the front edge portion 211. Thus, a contact state between the thighs and the seating board 11 improves, resulting in improvement in sitting comfort of the seating board 11 as a whole.

[1D-2] In the seating board 11 of the chair 1, the front edge portion 211 is covered by the seating portion 201 containing elastomer, which reduces user's direct contact with the front edge portion 211. This reduces user's discomfort at the time in contact with the front edge portion 211.

[1D-3] In the chair 1, the front edge portion 211 is provided with, on the rear thereof, the displacement restriction 212 that is less likely to elastically deform in the top-bottom direction. This reduces entire sinking of a wide range of the front portion of the seating board 11 when a user is seated.

[1D-4] In the chair 1, the front edge portion 211 is rectangular having a length in the left-right direction when seen from above, and the front edge portion 211 is capable of supporting the thighs in a wide range of the left-right direction. The front edge portion 211 has a shape inclined downward toward the front, thus, a load applied to the thighs gets smaller toward the front, and sitting comfort improves.

[1D-5] In the chair 1, a width in the left-right direction of the front edge portion 211 is configured to be smaller than a width in the left-right direction of a rear portion of the displacement restriction 212, that is, a rear portion of an auxiliary step 214. This reduces an elastic deformation of the displacement restriction 212 without significantly interfering an elastic deformation of the front edge portion 211.

[1-9. Correspondence]

In the present embodiment, the seat body 21 and the backrest 23 are examples of a support member in the present disclosure. The upper support 44 and the rear support 42 are examples of a first member in the present disclosure. The seating board 11 and the back board 13 are examples of a second member in the present disclosure. The second outer edge 49 and the end 74 are examples of a second outer periphery and an adjacent portion in the present disclosure. The thick portion 62 is one example of a non-composite portion in the present disclosure. The front support 41 is one example of a leg member in the present disclosure. The columnar body 81 of the leg tip 17 is one example of an adjacent portion in the present disclosure.

In the present embodiment, the thin portion 63 and the thin portion 61 are examples of a first outer periphery in the present disclosure. That is, in the present embodiment, a whole of the first outer periphery is formed as a thin portion.

In the present embodiment, the seating body composite portion 71 and the backrest composite portion 73 are examples of a composite portion and a structure body in the present disclosure. A structure including the recess 52 and the leg tip 17, and a structure including the recess 53 and the leg tip 17 are examples of a structure body in the present disclosure.

In the present embodiment, the front support 41, the rear support 42, and the lower support 43 are examples of a leg in the present disclosure. The lower support 43 is one example of a columnar portion in the present disclosure.

In the present embodiment, the framework 15 is one example of a support body. The upper support 44 is one example of an edge member. The screw member 65 is one example of a specified securing member. The front edge portion 211 is one example of a front declining portion. A front direction is one example of a first direction, the left-right direction is one example of a second direction intersecting the first direction.

2. Other Embodiments

Although the embodiment of the present disclosure has been described, the present disclosure is not limited to the above embodiment. It should be understood that the present disclosure can be practiced in various forms without departing from the technical scope of the present disclosure.

[2A-1] In the above-described embodiment, each of the seating body composite portion 71 and the backrest composite portion 73 (hereinafter, these are simply referred to as a composite portion) includes a part of the framework 15 as an element. However, the composite portion may be formed by elements other than framework 15 without including a part of the framework 15. The elements other than the framework 15 to configure the composite portion are not limited, and they may not be elements used to exhibit the chair's function, but may be elements mainly for fine appearance.

[2A-2] In the above-described embodiment, a configuration is exemplified in which the seat body 21 and the backrest 23 each has a composite portion. However, only one of the seat body 21 and the backrest 23 may have the composite portion. The position of the composite portion to be formed may be at least a part of an outer periphery or an entire part of the outer periphery of the seat body 21 and the backrest 23.

[2A-3] In the above-described embodiment, a configuration is exemplified in which the composite portion includes the thin portion 61 or the thin portion 63 without including thicker portion, such as the thick portion 62. However, for example, as a seating body composite portion 101 shown in FIG. 11A, the seating board 11 stacked on the upper support 44 may have a side surface portion 103 configured to be arranged not only on the thin portion 63, but also on the thick portion 62. That is, the composite portion may include portions other than the thin portion.

Figure 11A:
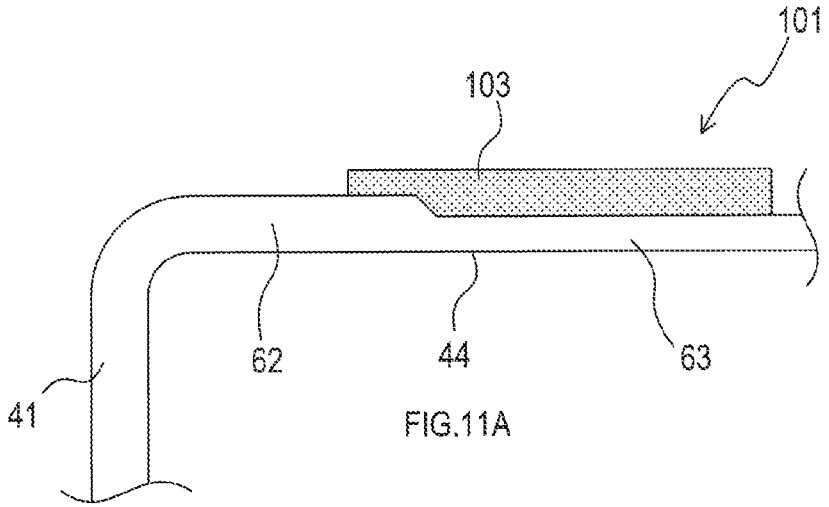
FIG. 11A to FIG. 11C illustrate variations of a composite portion.

FIG. 11A illustrates the side surface portion 103 by using only a portion stacked on the upper support 44, and omits a portion not stacked on the upper support 44. The same can be applied to the following variations.

Figure 11B:
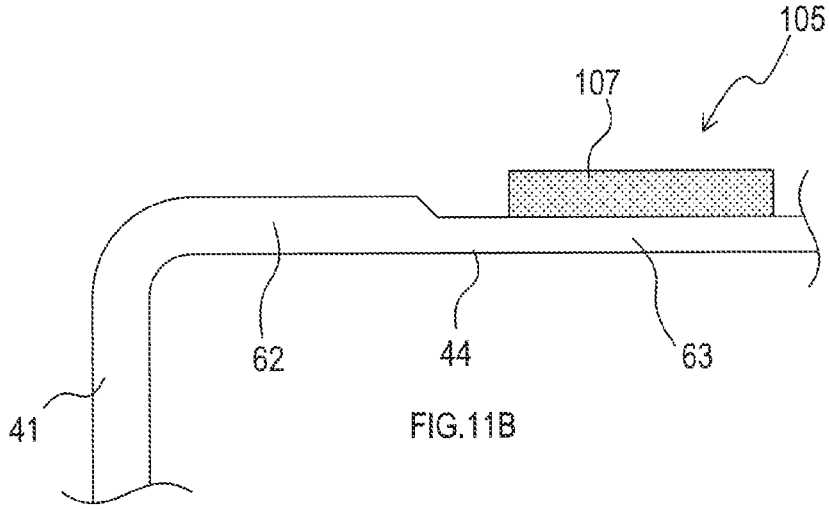

As a seating body composite portion 105 shown in FIG. 11B, the side surface portion 107 of the seating board 11 may not cover a whole of the thin portion 63 and a part of the thin portion 63 may not be included in a configuration of the seating body composite portion 105.

Figure 11C:
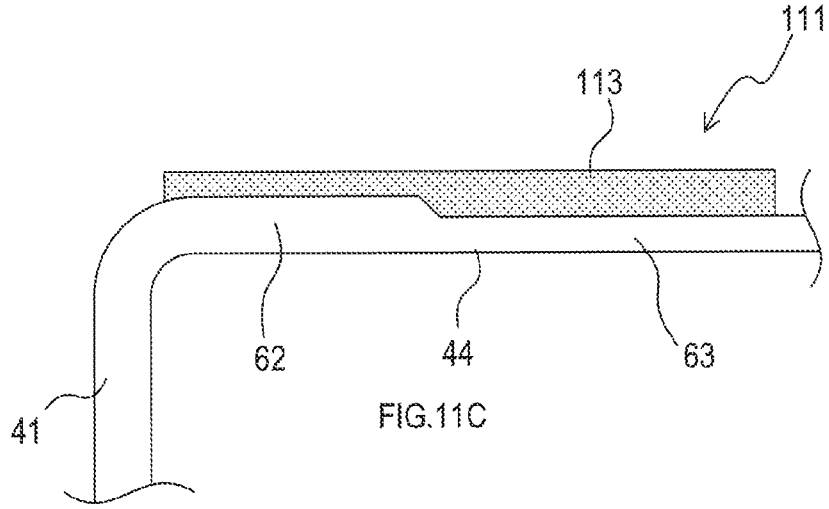

[2A-4] In the above-described embodiment, a configuration is exemplified in which in the seat body 21, the thick portion 62 thicker than the thin portion 63 is arranged, as a non-composite portion, on an outside of the seating body composite portion 71, more specifically, on an outside of the direction along an outer periphery of the seat body 21. However, the seat body 21 may have a configuration without including the non-composite portion. For example, as a seating body composite portion 111 shown in FIG. 11C, when a side surface portion 113 of the seating board 11 covers a whole of the thick portion 62 and the thin portion 63, such configuration does not have the non-composite portion.

Figure 12:
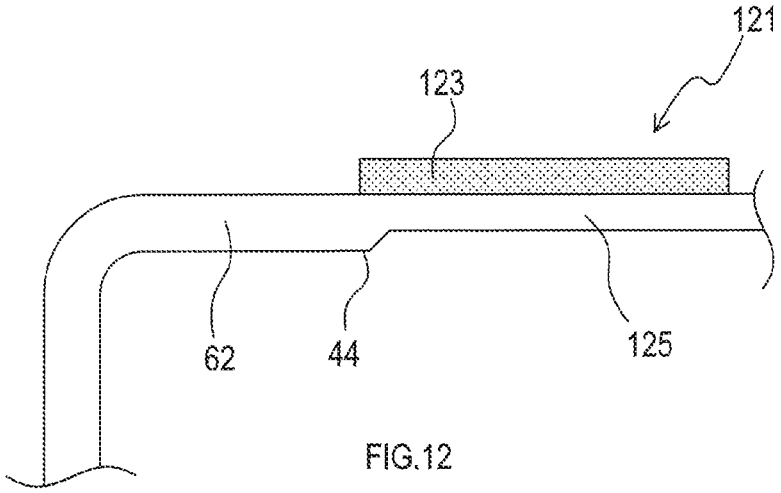
FIG. 12 illustrates a variation of the composite portion.

[2A-5] In the above-described embodiment, a configuration is exemplified in which the thin portion 61 and the thin portion 63 are recessed on a side of a side surface where the seating board 11 or the back board 13 is provided; however, a configuration in which an opposite side surface is recessed may be adopted. For example, as a seating body composite portion 121 shown in FIG. 12, a side surface portion 123 may be configured to be stacked on top opposite to a recessed lower side of a thin portion 125.

[2A-6] In the above-described embodiment, a configuration is exemplified in which an entire part after the thick portion 62 is formed as the thin portion 63 in the upper support 44. However, as a seating body composite portion 131 shown in FIG. 13, a configuration may be adopted in which a thick portion 133 is formed in front of a thin portion 132, and a thick portion 134 is formed after the thin portion 132. Although an illustration is omitted, a configuration may be adopted in which the thick portion 133 is not formed and the thick portion 134 is formed only after the thin portion 132.

Figure 13:
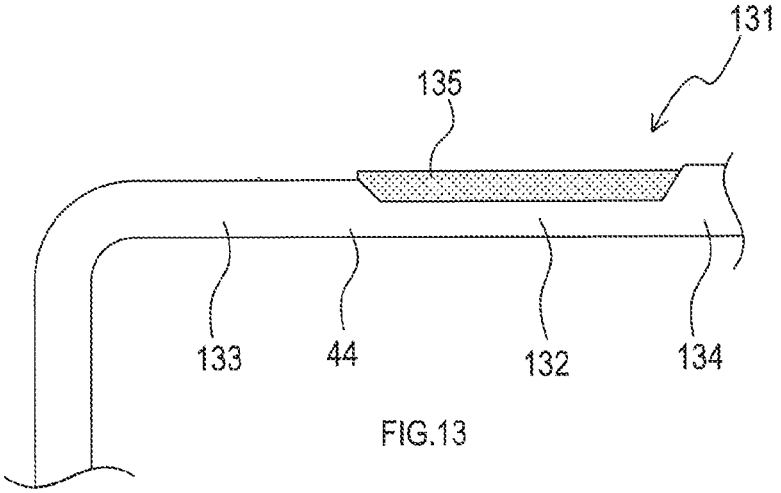
FIG. 13 illustrates a variation of the composite portion.

The thicknesses of the thick portion 133 and the thick portion 134 may not be the same. For example, as shown in FIG. 13, a thin portion 132 may be thinner, and the thick portion 134 may be thicker than a total thickness of the thin portion 132 and a side surface portion 135.

Figure 14:
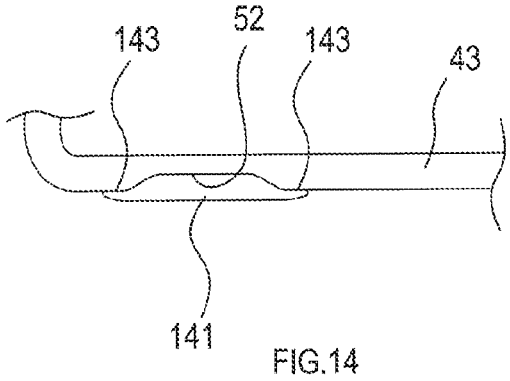
FIG. 14 illustrates a variation of the leg tip.

[2A-7] In The above-described embodiment, a configuration is exemplified in which the leg tip 17 abuts only the surface configuring each of the recess 52 and the recess 53. However, as a leg tip 141 shown in FIG. 14, the leg tip may have a contact surface 143 abutting an outer circumferential surface other than the recess 52 and the recess 53 in the outer circumferential surface of the lower support 43. The above-described outer circumferential surface coming into contact with the contact surface 143 is a circumferential wall of columnar shape in the lower support 43, that is, a surrounding part of each of the recess 52 and the recess 53.

[2A-8] In The above-described embodiment, configurations are exemplified in which the seating board 11 is attached to the framework 15 in a state where the thin portion 63 abuts the second outer edge 49, and the back board 13 is attached to the framework 15 in a state where the thin portion 61 abuts the end 74.

However, the thin portion may not abut a member adjacent thereto. For example, the thin portion and the adjacent member are arranged having a small gap between them.

[2B-1] In the above-described embodiment, a configuration is exemplified in which the pipe body 31 of the framework 15 is made of a metal pipe. However, a member having a shape other than a cylindrical pipe may be used for the pipe body 31. For example, a non-hollow solid material may be used, and a member having a cross-sectional shape of other than a circle, such as a rectangle, may be used. In other words, a substantially columnar member may be used for the lower support 43.

Figure 15:
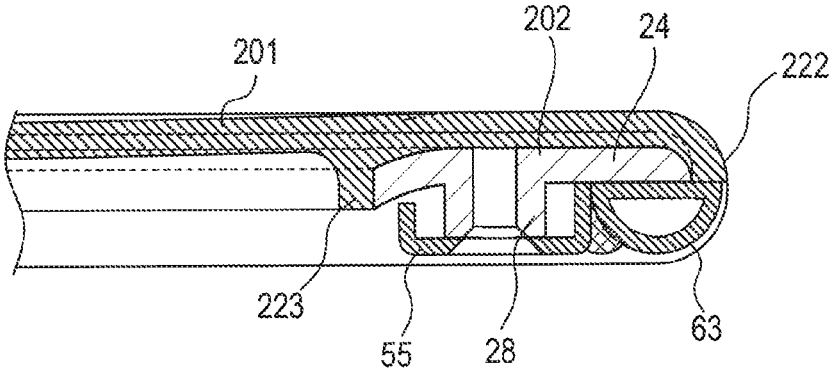
FIG. 15 is a sectional view of a variation of the first fixing portion seen from the same cross section as FIG. 5B.

[2C-1] In the above-described embodiment, a configuration is exemplified in which the first fixing portion 202 has a frame shape. However, a shape and an arrangement of the first fixing portion may be practiced in various forms within a range that the first fixing portion is fixed to the framework 15. For example, the first fixing portion may not have a frame shape, but may be provided only at a position where a female screw is formed. The first fixing portion may be configured not to have the front edge portion 211. The first fixing portion may be configured not to have the opening 27. As shown in FIG. 15, the protrusion 28 may be located in a middle of the left-right direction of the side frame 24 so as not to contact the inner wall 223.

[2C-2] In the above-described embodiment, the screw member 65 is exemplified as a securing member. However, any members other than a screw that are capable of fixing the first fixing portion 202 and the second fixing portion 34 may be used as the securing member. For example, a configuration may be adopted in which a rivet and a clip are used as the securing member for fixing. A tapping screw that requires no female screws may be used as a screw. When the object to which the tapping screw is attached is the first fixing portion 202 having a high rigidity, falling out of the tapping screw is reduced.

[2C-3] In the above-described embodiment, a configuration is exemplified in which the seating board 11 is formed by an integral formation of the seating portion 201 and the first fixing portion 202 using a two-color molding. However, the seating portion 201 and the first fixing portion 202 may be integrally formed by any methods other than the two-color molding. Alternatively, the seating portion and the first fixing portion may not be integrally formed but may be fixed by adhesive and other fixing components.

[2C-4] In the above-described embodiment, a configuration is exemplified in which a female screw is formed in the first fixing portion 202. However, a configuration may be adopted in which the first fixing portion is provided with a component having a female screw, such as a nut. For example, a configuration may be adopted in which the nut is arranged inside the first fixing portion by an insert molding.

[2C-5] In the above-described embodiment, a configuration is exemplified in which an upper surface of the first fixing portion 202 is entirely covered by the seating portion 201, in other words, the first fixing portion 202 is arranged under the seating portion 201. However, a configuration may be adopted in which a part or an entire part of the first fixing portion 202 is not covered by the seating portion 201 from above.

[2C-6] In the above-described embodiment, a configuration is exemplified in which the second outer edge 49 of the seating portion 201 covers a part of the upper support 44 from above. However, the upper support 44 may be configured not to be covered by the seating portion 201, and the seating portion 201 may be configured to cover an entire part of the upper support 44 including the thick portion 62.

[2C-7] In the above-described embodiment, a configuration is exemplified in which elastomer forming the seating portion 201 enters inside the slits 213. However, in the seating portion 201, the elastomer may not enter inside the slits 213. With the elastomer entered inside the slits 213, the seating portion 201 is firmly fixed to the first fixing portion 202.

Figure 16A:
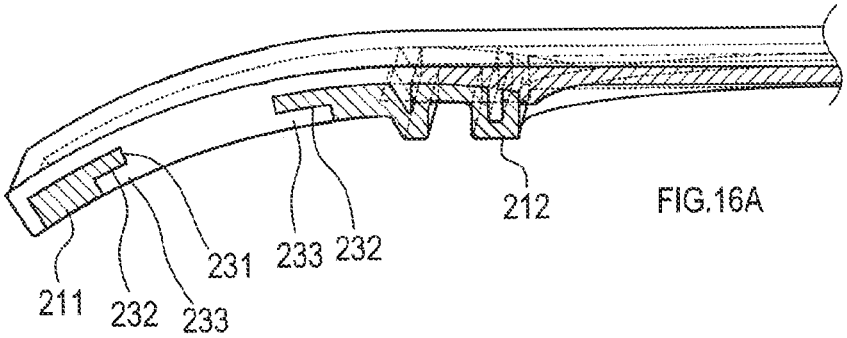
FIG. 16A to FIG. 16C are sectional views showing variations of a state of elastomer entered into slits.

The elastomer may pass through the slit to cover an undersurface of the front edge portion 211. For example, as shown in FIG. 16A, the undersurface of the slit 231 has an expansion 232 wider than the slit 231. The elastomer forming the seating portion 201 may have a cover 233 covering an undersurface of the front edge portion 211 and entering the expansion 232, thus, at least a part around the slit 231 may be covered from below.

Figure 16B:
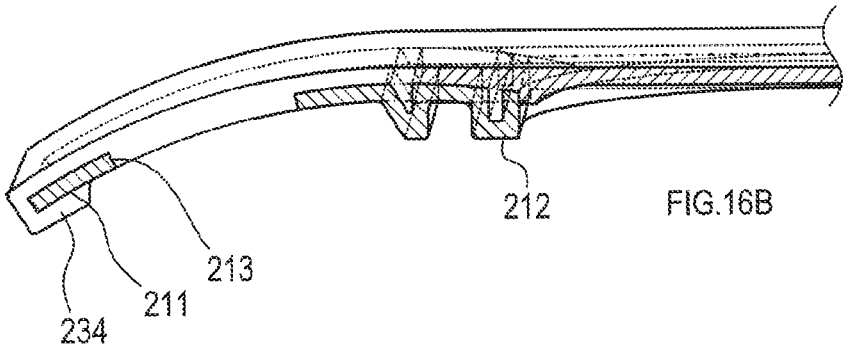

As shown in FIG. 16B, a cover 234 may be configured so as to cover an undersurface of the front end of the front edge portion 211.

Figure 16C:
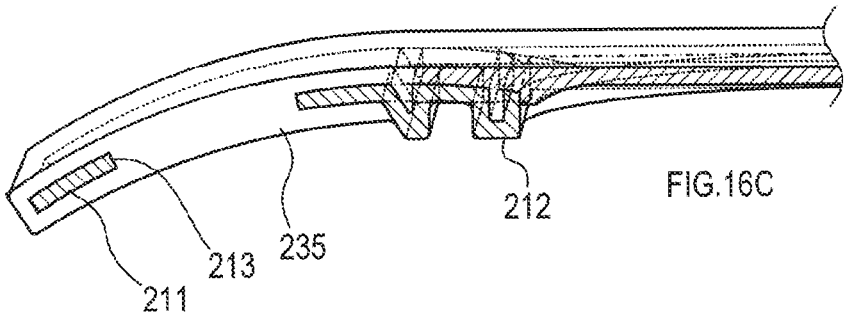

As shown in FIG. 16C, a cover 235 may be configured to widely cover the undersurface of the front edge portion 211.

[2D-1] In the above-described embodiment, a configuration is exemplified in which the front edge portion 211 is provided only on a front side of the seating board 11. However, the front edge portion may be provided not only on the front of the seating board 11, but also on left and right sides of the seating board 11.

[2D-2] In the above-described embodiment, a configuration is exemplified in which an elastic deformation of the displacement restriction 212 in the top-bottom direction is reduced by the front portion 56 of the second fixing portion 34 supporting from below. However, the elastic deformation of the displacement restriction may be reduced by its own structure. For example, the displacement restriction may be provided with a rib or a structure to improve rigidity, or the displacement restriction may be formed to be thicker in the top-bottom direction.

The displacement restriction may be supported from below by a member other than the front portion 56.

[2D-3] In the above-described embodiment, a configuration is exemplified in which an entire upper surface of the front edge portion 211 is covered by elastomer forming the seating portion 201, but a part or an entire part of the front edge portion 211 may not be covered by elastomer, and the upper surface thereof may be exposed.

[2D-4] In the above-described embodiment, a configuration is exemplified in which the front edge portion 211 is provided with a plurality of slits 213 having a length in the front-rear direction. However, the front edge portion 211 may not have the slits, or may have only one slit.

Figure 17A:
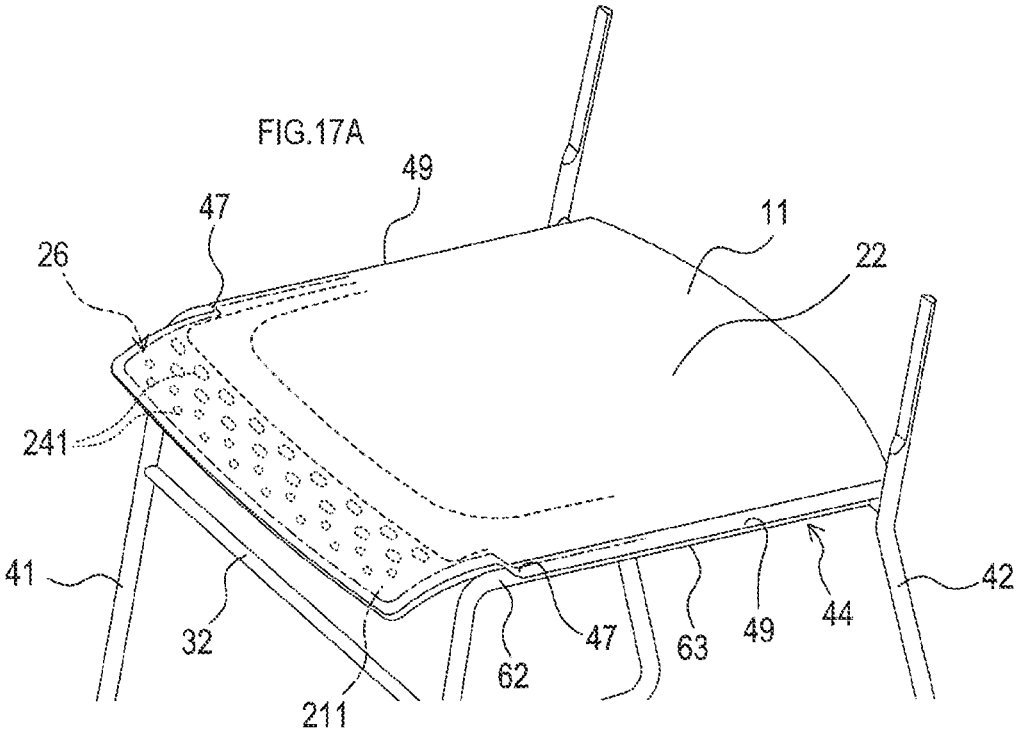
FIG. 17A and FIG. 17B are perspective views of variations of slits formed in a front frame.
Figure 17B:
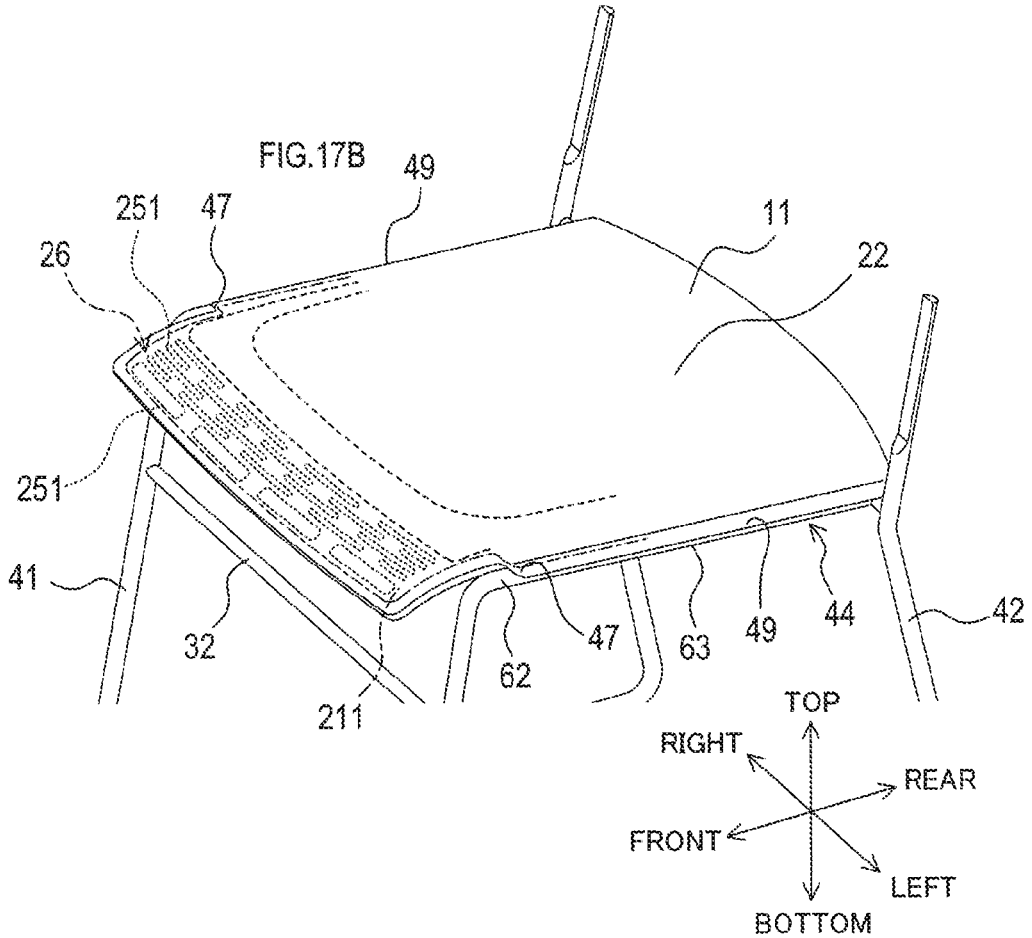

As shown in FIG. 17A, a plurality of through holes 241, such as an elongated hole and a round hole may be formed instead of slits. In this case, the through holes 241 may have different shapes. As shown in FIG. 17B, the front frame 26 may be provided with a plurality of slits 251 having a length in the left-right direction. In this case, the slits 251 may have different widths and lengths.

The through holes 241 and the slits 251 may be arranged in the front-rear direction so as to form a line, or a part or all of the through holes and the slits may be alternately arranged in the left-right direction so as not to form a line in the front-rear direction. A diameter of the through hole and a width and length of the slit may be smaller toward the front, or on the contrary, they may be smaller toward the rear.

The front edge portion 211 may be provided with an imperforated recess and groove instead of the through hole and slit. The front edge may also be provided with a rib or other members to reduce an amount of an elastic deformation.

Figure 18:
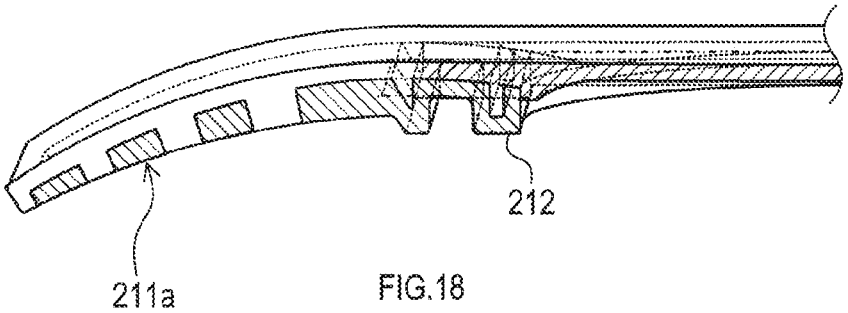
FIG. 18 is a sectional view seen from the same cross section as FIG. 1F and showing a variation of a thickness of the front edge portion.

[2D-5] In the above-described embodiment, a configuration is exemplified in which the front edge portion 211 has a constant thickness in the top-bottom direction; however, as shown in FIG. 18, a front edge portion 211*a* may have a varying thickness in the top-bottom direction along positions in the front-rear direction. Since the front edge portion 211*a* is formed to be thinner toward the front, flexibility in the front part increases. On the contrary, the front edge portion may be thinner toward the rear.

[2D-6] In the above-described embodiment, a configuration is exemplified in which the seating board 11 includes the seating portion 201 and the first fixing portion 202. However, the seating board may further comprise, for example, a cushion member including polyurethane foam and the like.

[2D-7] In the above-described embodiment, a configuration is exemplified in which the front edge portion 211 has a plate shape having a curved surface. However, the front edge portion may have a flat plate shape. The front edge portion may also have a planer shape. Here, the planar shape means that a part of the front edge portion supporting thighs, that is, a top of the front edge portion extends so as to form a surface. For example, the front edge portion may be formed, for example, by a bar-shaped member, wire, cloth, mesh, and a combination of blocks, and even if the front edge portion itself does not have a plate shape, an area in contact with and supporting the thighs may extend so as to form a planner or curved surface.

More specifically, examples of the front edge may include: bar-shaped members assembled in a lattice, grid, and net shape; wire and/or cloth members wound around left and right support members arranged at a distance from each other; and block members having a shape of sphere or cuboid arranged two-dimensionally and fixed each other.

The invention claimed is:

1. A chair including:

a seating board; and a support body supporting the seating board, wherein the seating board includes a seating portion forming a seating surface and made of at least one elastomer, and a first fixing portion fixed to the seating portion and formed by a member with higher rigidity than the seating portion, wherein the support body includes a second fixing portion, wherein the first fixing portion is a frame member formed along an edge of the seating portion, the frame member having an opening in a center of the frame member, and wherein the seating board and the support body are fixed by fixing the first fixing portion and the second fixing portion using a specified securing member.

2. The chair according to claim 1, wherein the first fixing portion is made of at least one resin, wherein the seating portion and the first fixing portion are integrally formed, and wherein an entire upper surface of the first fixing portion is closely attached to an undersurface of the seating portion.

3. The chair according to claim 1, wherein the first fixing portion is formed along an edge of at least a part of the seating portion in a state where the first fixing portion is placed on an undersurface of the seating portion.

4. The chair according to claim 1, wherein the securing member is a member having a male screw, wherein the first fixing portion has a female screw fastened to the male screw, wherein the second fixing portion has a through hole to which the male screw can be inserted, and wherein the first fixing portion and the second fixing portion is fixed by inserting the male screw to the through hole and fastening the male screw to the female screw.

5. The chair according to claim 1, wherein the first fixing portion has, at an end in a first direction of the seating board, a front declining portion formed so as to extend in a second direction crossing the first direction, and wherein the end in the first direction inclines downward.

6. The chair according to claim 1, wherein the support body has an edge member that is a tubular member or a columnar member, the edge member being arranged along the edge of at least a part of the seating portion, wherein the seating board is configured such that the seating portion covers at least the part of the edge member from above.

7. The chair according to claim 1, wherein the seating portion fully covers the first fixing portion when seen from above.

8. The chair according to claim 1, wherein the seating portion is closely attached to and covers a side surface on an outer peripheral side of the first fixing portion.

9. A structure body of a chair including a composite portion including a part of a first member embodying a rear support of the chair extending upward relative to a seat body; and an adjacent portion that is a part of a second member of a back board of the chair, the adjacent portion being arranged to overlap the first member, wherein in the composite portion, the part of the first member is formed into a thin portion thinner than an outside portion of the first member not overlapped by the adjacent portion.

* * * * *